US012546026B2

(12) United States Patent
Tsuji

(10) Patent No.: US 12,546,026 B2
(45) Date of Patent: Feb. 10, 2026

(54) PLATING APPARATUS AND PLATING METHOD

(71) Applicant: EBARA CORPORATION, Tokyo (JP)

(72) Inventor: Kazuhito Tsuji, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 73 days.

(21) Appl. No.: 18/282,765

(22) PCT Filed: Aug. 9, 2022

(86) PCT No.: PCT/JP2022/030375
§ 371 (c)(1),
(2) Date: Sep. 18, 2023

(87) PCT Pub. No.: WO2024/033999
PCT Pub. Date: Feb. 15, 2024

(65) Prior Publication Data

US 2025/0034745 A1 Jan. 30, 2025

(51) Int. Cl.
*C25D 17/06* (2006.01)
*C25D 17/00* (2006.01)
(Continued)

(52) U.S. Cl.
CPC ..... *C25D 17/02* (2013.01); *C25D 17/002* (2013.01); *C25D 17/06* (2013.01); *C25D 21/10* (2013.01); *C25D 21/14* (2013.01)

(58) Field of Classification Search
None
See application file for complete search history.

(56) References Cited

U.S. PATENT DOCUMENTS 6,251,235 B1 * 6/2001 Talieh ..... C25D 17/001 204/297.05
7,285,195 B2 * 10/2007 Herchen ..... C25D 17/06 204/224 R
(Continued)

FOREIGN PATENT DOCUMENTS

JP 2002275696 A * 9/2002
JP 2009-293088 A 12/2009
(Continued)

*Primary Examiner* — Stefanie S Wittenberg
(74) *Attorney, Agent, or Firm* — BakerHostetler

(57) ABSTRACT

A plating apparatus includes a plating tank configured to store a plating solution, a substrate holder configured to hold a substrate as a target on which a plating process is performed, a rotation mechanism that rotates the substrate holder, an elevating/lowering mechanism that elevates and lowers the substrate holder, and a control device, and the substrate holder includes a contact member configured to contact the substrate to be able to supply power to the substrate, a sealing member configured to seal a gap between the substrate holder and the substrate, a liquid holding portion including the contact member inside, and being configured to be able to hold liquid when the gap between the substrate holder and the substrate is sealed with the sealing member, and a spout port that is configured to open into the liquid holding portion or a space communicating with the liquid holding portion inside the substrate holder, or that can be disposed on a side of the substrate holder, to spout the liquid.

28 Claims, 27 Drawing Sheets

(51) Int. Cl.

| | |
|---|---|
| ***C25D 17/02*** | (2006.01) |
| ***C25D 21/10*** | (2006.01) |
| ***C25D 21/14*** | (2006.01) |

(56) References Cited

U.S. PATENT DOCUMENTS

| | | | | |
|---|---|---|---|---|
| 2004/0140199 | A1* | 7/2004 | Mizohata | C25D 17/001 257/E21.175 |
| 2004/0140203 | A1 | 7/2004 | Burkhart et al. | |
| 2006/0027452 | A1* | 2/2006 | Mishima | H01L 21/681 205/123 |
| 2016/0222535 | A1* | 8/2016 | Zhou | C25D 5/04 |
| 2017/0350033 | A1* | 12/2017 | Fujikata | C25D 21/12 |
| 2020/0149180 | A1 | 5/2020 | Nishimoto et al. | |

FOREIGN PATENT DOCUMENTS

| | | | |
|---|---|---|---|
| JP | 2019-026863 | A | 2/2019 |
| JP | 6893142 | B2 | 6/2021 |
| JP | 7047200 | B1 | 4/2022 |
| JP | 7081063 | B1 | 6/2022 |
| WO | WO 2023/067650 | A1 | 4/2023 |
| WO | WO 2023/079634 | A1 | 5/2023 |

* cited by examiner

440

PLATING APPARATUS AND PLATING METHOD

CROSS-REFERENCE TO RELATED APPLICATIONS

This application is a U.S. national phase application of International Patent Application No. PCT/JP2022/030375 filed Aug. 9, 2022, which is incorporated by reference in its entirety for any and all purposes.

TECHNICAL FIELD

The present invention relates to a plating apparatus and a plating method.

BACKGROUND ART

As a plating apparatus, an electrolytically plating apparatus of a cup type, a dip type or the like is known. In the cup type electrolytically plating apparatus, a substrate (for example, a semiconductor wafer) held by a substrate holder with a surface to be plated being oriented downward is immersed in a plating solution, and a voltage is applied between the substrate and an anode, thereby precipitating an electrically conductive film on a substrate surface (see PTLs 1 and 2). In the dip type electrolytically plating apparatus, a plating process is performed in a state where the surface to be plated is laterally oriented (see PTL 3).

A contact member for supplying power in contact with the substrate is provided in a substrate holder of such a plating apparatus. Further, the substrate holder includes a sealing member that performs sealing to prevent the contact member from being brought into contact with the plating solution during the plating process. In the electrolytically plating apparatus of PTL 3, to prevent the plating solution from intruding into a sealed space housing the contact member in a workpiece holding jig, the sealed space is filled with a liquid that does not contain metal salt.

CITATION LIST

Patent Literature

PTL 1: Japanese Patent No. 7047200
PTL 2: Japanese Patent No. 7081063
PTL 3: Japanese Patent No. 6893142

SUMMARY OF INVENTION

Technical Problem

If there are contaminants such as plating solution components inside a substrate holder, metal components might be deposited to cause damages on a contact member, and a seed layer of a substrate might dissolve to cause nonuniformity of a plating thickness due to power supply variation. It is desirable to suppress adverse effect of contaminant inside the substrate holder on the contact member or the like while achieving an efficient plating process.

The present invention has been made in view of the above problems. One object of the present invention is to provide a plating method and a plating apparatus that can suppress adverse effect of contaminant inside a substrate holder on a contact member or the like.

Solution to Problem

According to one embodiment of the present invention, a plating apparatus is provided. The plating apparatus includes a plating tank configured to store a plating solution, a substrate holder configured to hold a substrate as a target on which a plating process is performed, a rotation mechanism that rotates the substrate holder, an elevating/lowering mechanism that elevates and lowers the substrate holder, and a control device, and the substrate holder includes a contact member configured to contact the substrate to be able to supply power to the substrate, a sealing member configured to seal a gap between the substrate holder and the substrate, a pressing member disposed opposing the sealing member, and configured to press the substrate against the sealing member, a liquid holding portion including the contact member inside, and being configured to be able to hold liquid when the gap between the substrate holder and the substrate is sealed with the sealing member, and a spout port that is configured to open into the liquid holding portion or a space communicating with the liquid holding portion inside the substrate holder, or that can be disposed on a side of the substrate holder, to spout the liquid.

According to another embodiment of the present invention, a plating method is provided. This plating method is a plating method for performing a plating process with a plating apparatus including a plating tank configured to store a plating solution, a substrate holder configured to hold a substrate as a target on which the plating process is performed, a rotation mechanism that rotates the substrate holder, and an elevating/lowering mechanism that elevates and lowers the substrate holder, the substrate holder including a contact member configured to contact the substrate to be able to supply power to the substrate, a sealing member configured to seal a gap between the substrate holder and the substrate, a liquid holding portion including the contact member inside and being configured to be able to hold liquid when the gap between the substrate holder and the substrate is sealed with the sealing member, and a spout port that opens into the liquid holding portion or a space communicating with the liquid holding portion in the substrate holder, or that can be disposed on a side of the substrate holder, the plating method including attaching the substrate to the substrate holder, spouting the liquid from the spout port, rotating the substrate holder to move the spouted liquid to the liquid holding portion or to distribute the liquid more uniformly in the liquid holding portion, and performing the plating process on the attached substrate.

DESCRIPTION OF EMBODIMENTS

Figure 1:
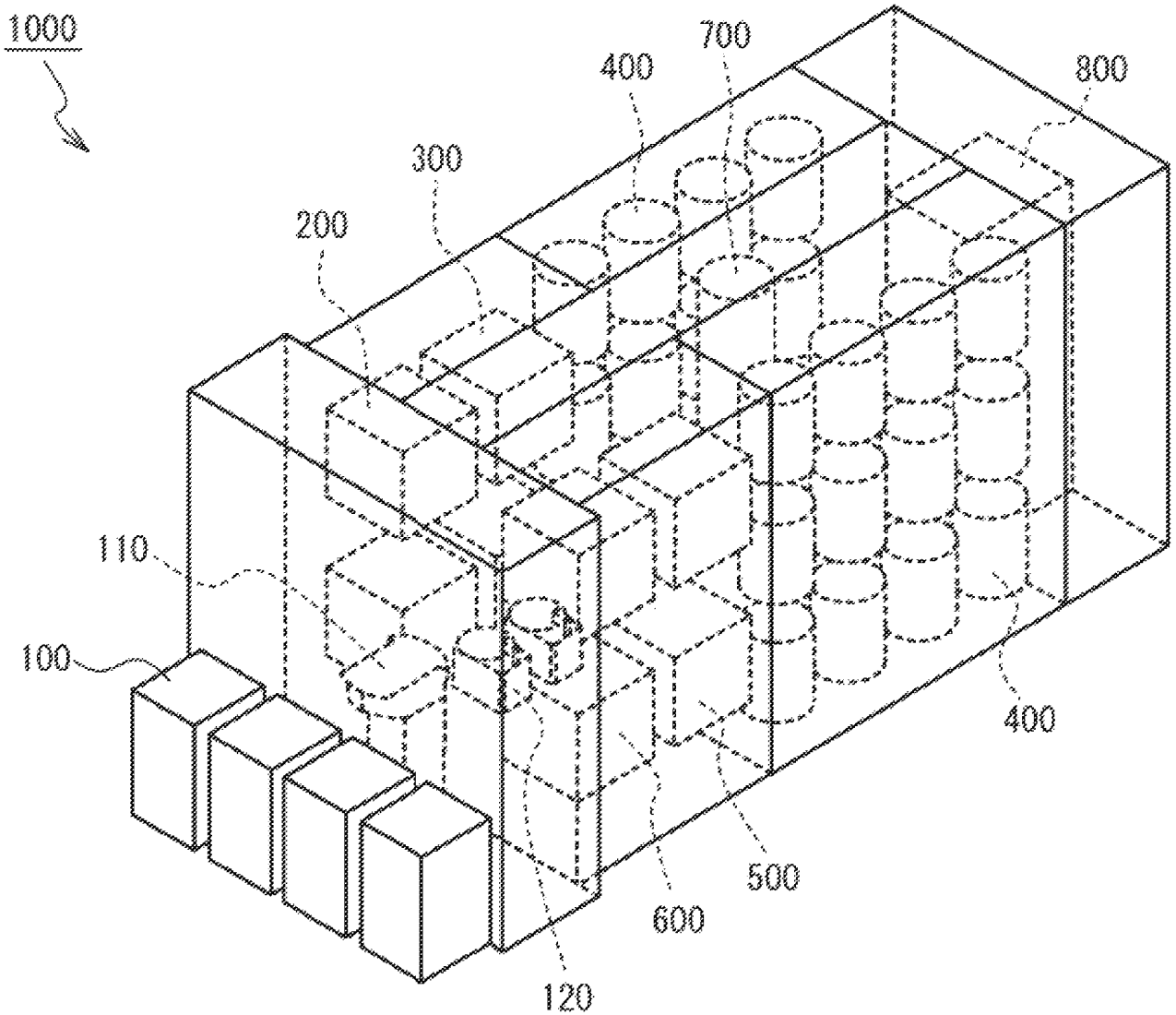
FIG. 1 is a perspective view illustrating an overall configuration of a plating apparatus of a first embodiment.

Hereinafter, embodiments of the present invention will be described with reference to the drawings. In the drawings described below, the same or corresponding components are denoted with the same reference sign and will not be described in duplicate.

First Embodiment

<Overall Configuration of Plating Apparatus>

Figure 2:
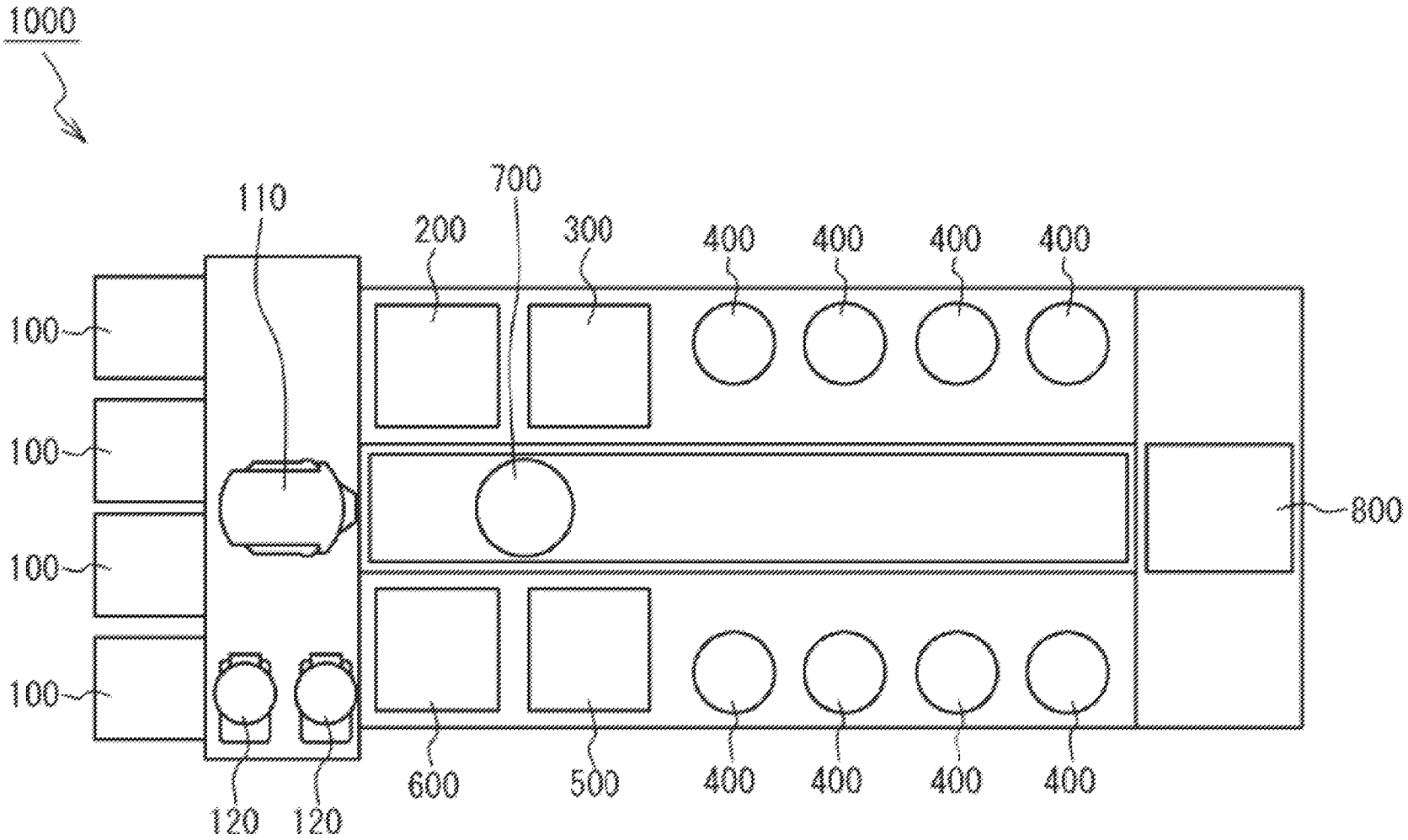
FIG. 2 is a plan view illustrating the overall configuration of the plating apparatus of the first embodiment.

FIG. 1 is a perspective view illustrating the overall configuration of a plating apparatus 1000 of a first embodiment. FIG. 2 is a plan view illustrating the overall configuration of the plating apparatus 1000. As illustrated in FIGS. 1 and 2, the plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid (pre-wet liquid), such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The pre-soak process need not be performed, and the plating apparatus 1000 need not include any presoak modules. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers are disposed to be arranged in the vertical direction in this embodiment, the number of spin rinse dryers and arrangement of the spin rinse dryers are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200. The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

<Configuration of Plating Module>

Figure 3:
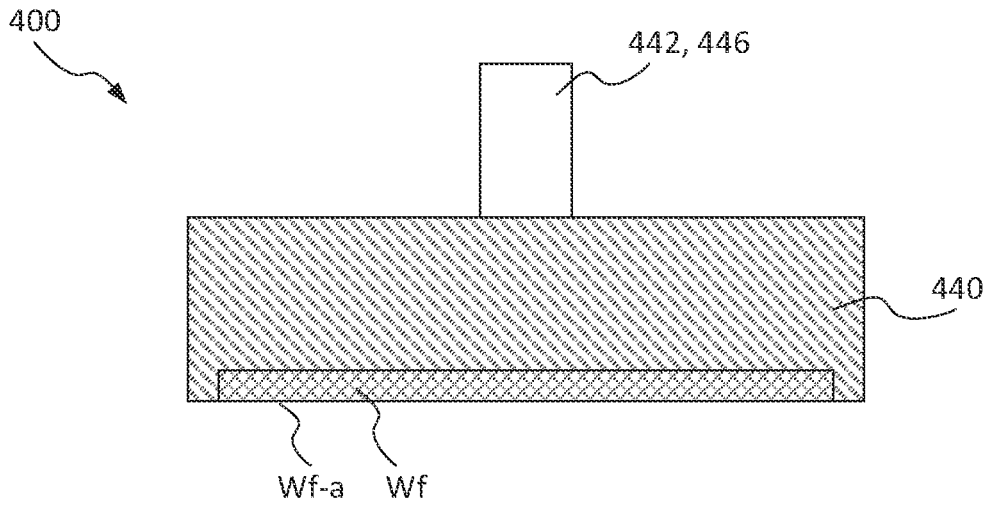
FIG. 3 is a longitudinal sectional view schematically illustrating a configuration of a plating module of the first embodiment.
Figure 3:
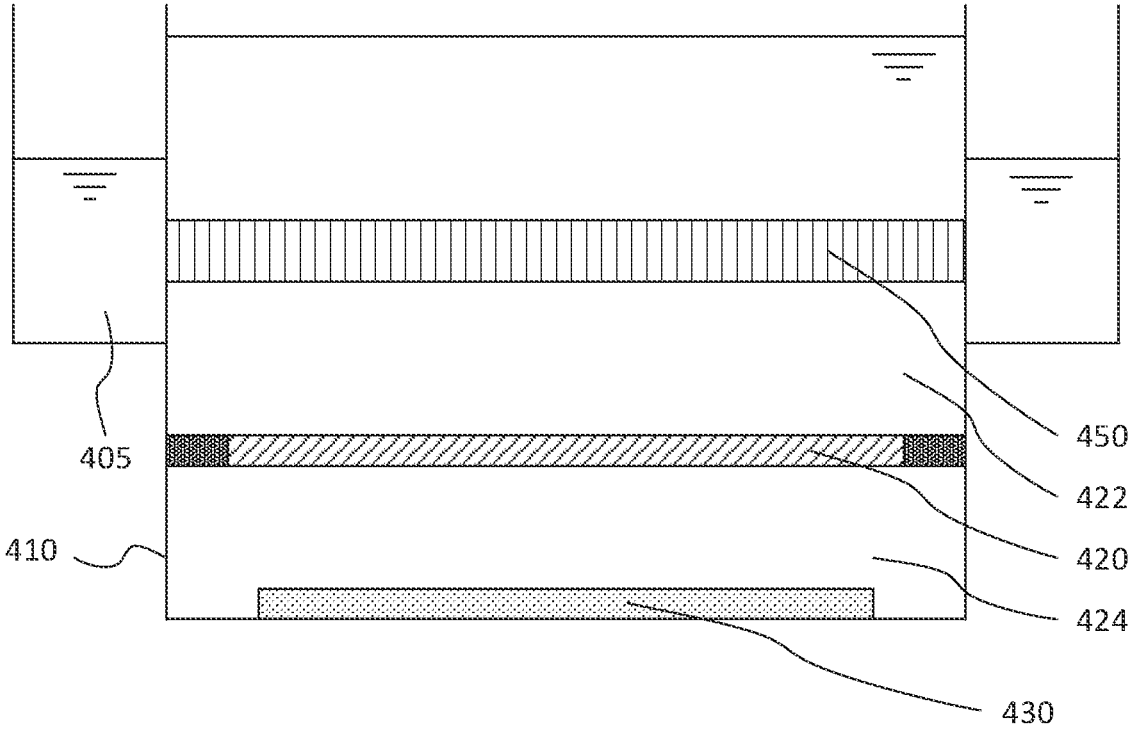

Next, a configuration of the plating module 400 will be described. Since 24 plating modules 400 in the present embodiment have the same configuration, one plating module 400 alone will be described. FIG. 3 is a longitudinal sectional view schematically illustrating the configuration of the plating module 400 of the present embodiment. As illustrated in FIG. 3, the plating module 400 includes a plating tank 410 for storing a plating solution. The plating tank 410 is a container including a cylindrical side wall and a round bottom wall, and has an upper part formed with a round opening. The plating module 400 also includes an overflow tank 405 disposed outside the upper opening of the plating tank 410. The overflow tank 405 is a container for receiving the plating solution overflown from the upper opening of the plating tank 410.

The plating module 400 includes a membrane 420 that separates an inside of the plating tank 410 in an up-down direction. The inside of the plating tank 410 is divided into a cathode region 422 and an anode region 424 by the membrane 420. The cathode region 422 and the anode region 424 are each filled with the plating solution. On a bottom surface of the plating tank 410 of the anode region 424, an anode 430 is provided. In the cathode region 422, a resistor 450 opposing the membrane 420 is disposed. The resistor 450 is a member for uniformly performing the plating process in a surface to be plated Wf-a of a substrate Wf and is composed of a plate-shaped member including a large number of holes formed therein. While the plating process can be performed with desired accuracy, the resistor 450 need not be disposed in the plating tank 410.

The plating solution may be a solution containing ions of metal elements constituting a plating film, and specific examples thereof are not particularly limited. As an example of the plating process, copper plating can be used, and as an example of plating solution, copper sulfate solution can be used. In the present embodiment, the plating solution contains a predetermined additive. However, the present invention is not limited to this configuration, and the plating solution may be configured to contain no additives.

A specific type of anode 430 is not particularly limited, and a dissolved anode or an insoluble anode may be used. In the present embodiment, the insoluble anode is used as the anode 430. The specific type of insoluble anode is not particularly limited, and platinum, iridium oxide, or the like may be used.

The plating module 400 includes a substrate holder 440 for holding the substrate Wf with the surface to be plated Wf-a being oriented downward. The plating module 400 includes a first elevating/lowering mechanism 442 for elevating and lowering the substrate holder 440. The first elevating/lowering mechanism 442 can be achieved by a known mechanism such as a direct-acting actuator. The plating module 400 includes a rotation mechanism 446 for rotating the substrate holder 440 so that the substrate Wf rotates about a virtual rotation axis extending perpendicularly in the center of the surface to be plated Wf-a. The rotation mechanism 446 can be achieved by a known mechanism such as a motor.

The plating module 400 is configured to immerse the substrate Wf in the plating solution of the cathode region 422 by use of the first elevating/lowering mechanism 442 and apply a voltage between the anode 430 and the substrate Wf while rotating the substrate Wf by use of the rotation mechanism 446, thereby performing the plating process on the surface to be plated Wf-a of the substrate Wf.

Figure 4:
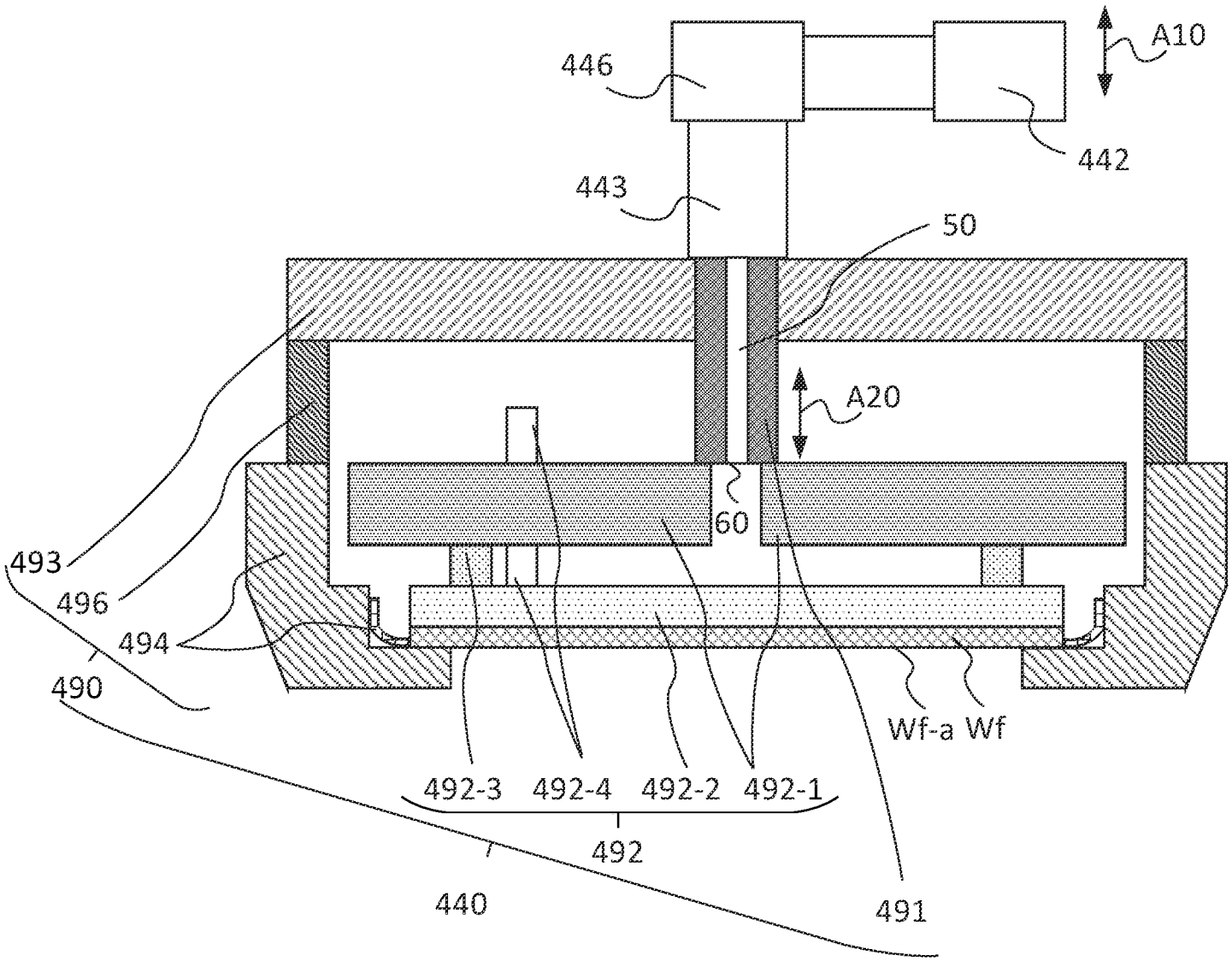
FIG. 4 is a longitudinal sectional view schematically illustrating a substrate holder of the first embodiment.

FIG. 4 is a longitudinal sectional view schematically illustrating the substrate holder 440. The substrate holder 440 includes a supporter 490 that supports the substrate Wf, a back plate assembly 492 that sandwiches the substrate Wf together with the supporter 490, and a rotary shaft 491 extending vertically upward from the back plate assembly 492. The supporter 490 includes a first upper member 493, a second upper member 496, and a support mechanism 494 for supporting an outer peripheral portion of the surface to be plated Wf-a of the substrate Wf. The first upper member 493 holds the second upper member 496. In the illustrated example, the first upper member 493 extends in a substantially horizontal direction, and the second upper member 496 extends in a substantially vertical direction, which is not limited. The support mechanism 494 is an annular member having an opening in the center thereof for exposing the surface to be plated Wf-a of the substrate Wf and is suspended and held by the second upper member 496. The second upper member 496 can include one or more column members placed on an annular upper surface of the support mechanism 494.

The back plate assembly 492 includes a disc-shaped floating plate 492-2 for sandwiching the substrate Wf together with the support mechanism 494. The floating plate 492-2 is disposed on a back side of the surface to be plated Wf-a of the substrate Wf. The back plate assembly 492 includes a disc-shaped back plate 492-1 disposed above the floating plate 492-2. The back plate assembly 492 also includes a floating mechanism 492-4 for energizing the floating plate 492-2 in a direction apart from a back surface of the substrate Wf, and a pressing mechanism 492-3 for pressing the floating plate 492-2 to the back surface of the substrate Wf against an energizing force generated by the floating mechanism 492-4.

The floating mechanism 492-4 includes a compression spring attached between an upper end of a shaft extending upward from the floating plate 492-2 through the back plate 492-1 and the back plate 492-1. The floating mechanism 492-4 is configured to lift the floating plate 492-2 upward via the shaft with a compression reaction force of the compression spring and to energize the plate in a direction apart from the back surface of the substrate Wf. The floating mechanism 492-4 is not illustrated in the following drawings as appropriate.

The pressing mechanism 492-3 is configured to press the floating plate 492-2 downward by supplying fluid to the floating plate 492-2 via an unillustrated flow path formed inside the back plate 492-1. When fluid is supplied, the pressing mechanism 492-3 presses the substrate Wf to the support mechanism 494 with a force stronger than the energizing force of the floating mechanism 492-4. The floating plate 492-2 is a pressing member disposed opposing a sealing member 494-2 (FIG. 5) described later and configured to press the substrate Wf against the sealing member 494-2.

The first elevating/lowering mechanism 442 elevates and lowers the entire substrate holder 440 (arrow A10). The plating module 400 further includes a second elevating/lowering mechanism 443. The second elevating/lowering mechanism 443 is driven by a known mechanism such as a direct-acting actuator to elevate and lower the rotary shaft 491 and the back plate assembly 492 with respect to the supporter 490 (arrow A20). In the rotary shaft 491, a spout port 60 for spouting liquid and a supply flow path 50 connected to the spout port 60 so that the liquid is movable are formed. The spout port 60 will be described in detail later.

Figure 5:
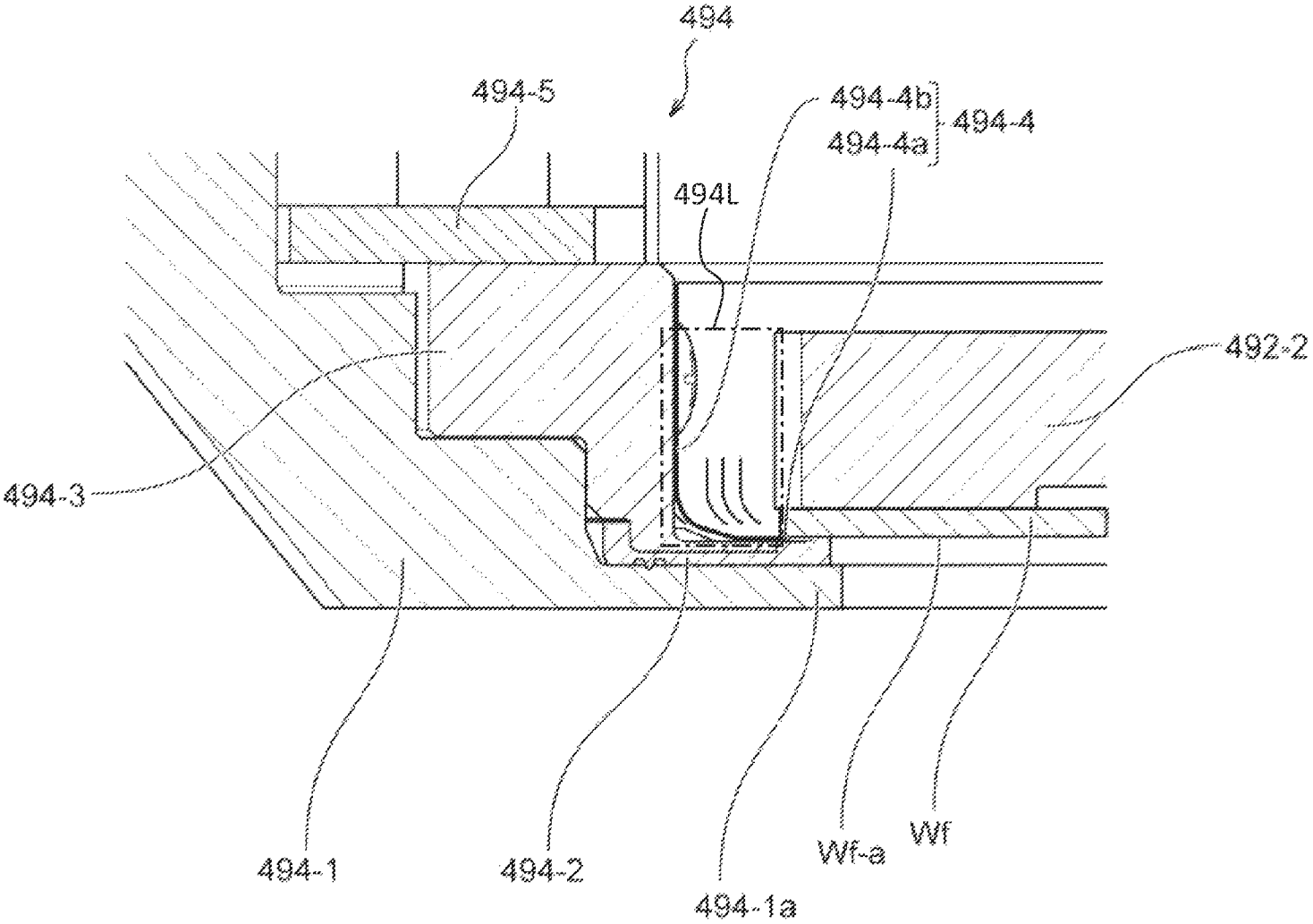
FIG. 5 is a longitudinal sectional view of the substrate holder schematically illustrating a contact member of the first embodiment.

FIG. 5 is a longitudinal sectional view schematically illustrating an enlarged part of a configuration of the substrate holder 440. The support mechanism 494 includes an annular support member 494-1 that supports the outer peripheral portion of the surface to be plated Wf-a of the substrate Wf. The support member 494-1 includes a flange 494-1*a* extending out to an outer peripheral portion of a lower surface of the back plate assembly 492 (floating plate 492-2). The sealing member 494-2 that is annular and configured to seal the substrate Wf is disposed on the flange 494-1*a*. The sealing member 494-2 is an elastic member. The support member 494-1 supports the outer peripheral portion of the surface to be plated Wf-a of the substrate Wf via the sealing member 494-2. When the substrate Wf is plated, a gap between the support member 494-1 (substrate holder 440) and the substrate Wf is sealed by sandwiching the substrate Wf between the sealing member 494-2 and the floating plate 492-2.

The support mechanism 494 includes an annular base 494-3 attached to an inner peripheral surface of the support member 494-1 and an annular electrically conductive member 494-5 attached to an upper surface of the base 494-3. The base 494-3 is an electrically conductive member such as stainless steel. The electrically conductive member 494-5 is an electrically conductive annular member and can contain, for example, copper or another metal.

The support mechanism 494 includes a contact member 494-4 configured to contact the substrate Wf to be able to supply power to the substrate. The contact member 494-4 is annularly attached to the inner peripheral surface of the base 494-3 with screws or the like. The support member 494-1 holds the contact member 494-4 via the base 494-3. The contact member 494-4 is a member having an electrical conductivity for supplying power from an unillustrated power source to the substrate Wf held by the substrate holder 440. The contact member 494-4 includes a plurality of substrate contacts 494-4*a* that contact the outer peripheral portion of the surface to be plated Wf-a of the substrate Wf, and a main body portion 494-4*b* extending upward from the substrate contacts 494-4*a*.

The substrate holder 440 includes a liquid holding portion 494L configured to be able to hold liquid inside the substrate holder 440 when the substrate Wf is sealed with the sealing member 494-2. Inside the liquid holding portion 494L, the contact member 494-4 is disposed. The liquid holding portion 494L may include a plurality of side walls facing each other and sandwiching the contact member 494-4, and a bottom wall below the contact member 494-4. In an illustrated example, the liquid holding portion 494L includes an outer lateral surface of the disc-shaped floating plate 492-2, and an inner lateral surface and a bottom surface of the support member 494-1. Thus, when the gap between the substrate holder 440 and the substrate Wf is sealed with the sealing member 494-2, the contact member 494-4 can be covered efficiently with a small amount of liquid. Here, the outer lateral surface of the floating plate 492-2 lies above the sealing member 494-2 and extends in a substantially vertical direction. The bottom surface of the support member 494-1 refers to a surface formed above the flange 494-1*a* protruding inward in a radial direction of the substrate holder 440, the surface extending along the flange 494-1*a*.

When the substrate Wf is not attached to the substrate holder 440, liquid may drop through a gap between the floating plate 492-2 and the sealing member 494-2. When the substrate Wf is sandwiched and sealed between the floating plate 492-2 and the sealing member 494-2, the liquid holding portion 494L can prevent such liquid from dropping and hold the liquid. It should be noted that a recess can be formed in a bottom wall constituting the liquid holding portion 494L, so that even when the substrate Wf is not attached to the substrate holder 440, a small amount of liquid can be held in the liquid holding portion 494L.

Figure 6:
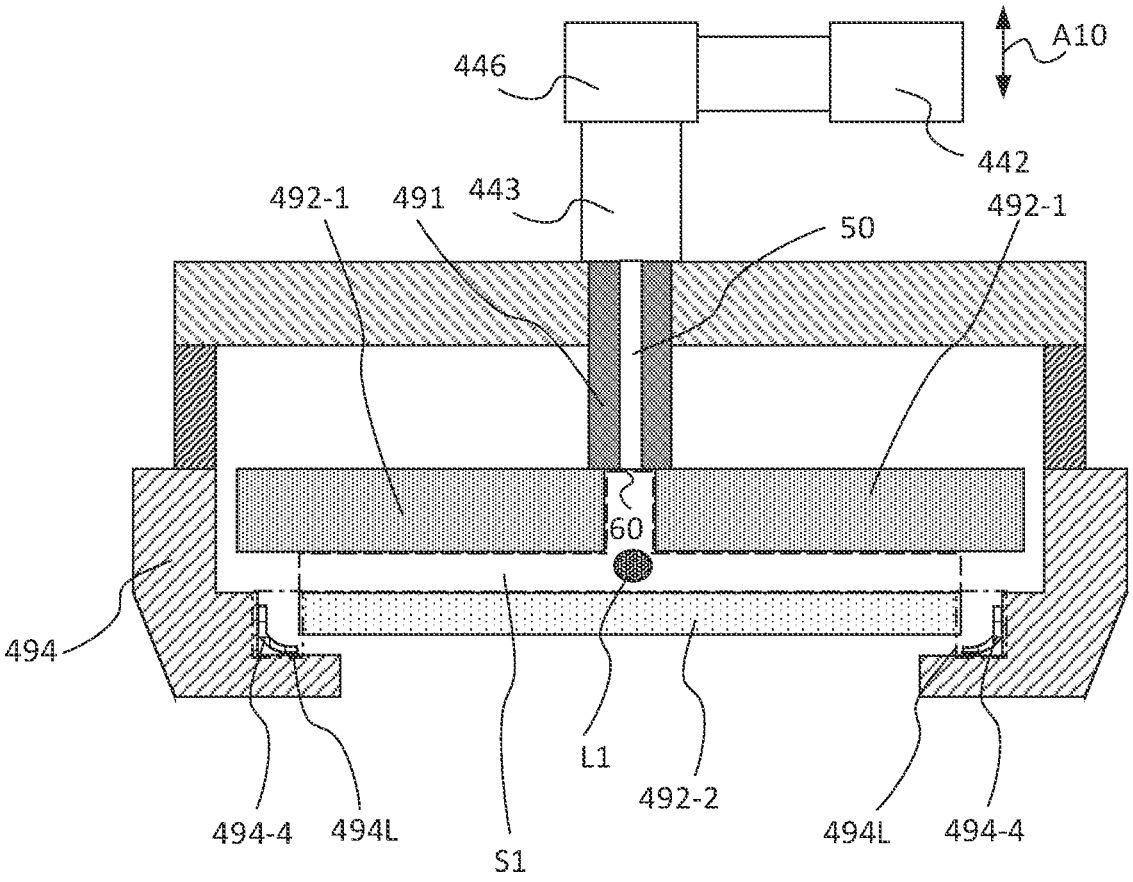
FIG. 6 is a longitudinal sectional view schematically illustrating a liquid holding portion of the substrate holder.

FIG. 6 is a conceptual diagram for describing a space inside the substrate holder 440. Inside the substrate holder 440, the spout port 60 for spouting liquid L1 is formed. The spout port 60 opens into the liquid holding portion 494L, or a space communicating with the liquid holding portion 494L inside the substrate holder 440. In an illustrated example, the spout port 60 is formed above the floating plate 492-2 and opens into an inner space SI above the floating plate 492-2. In the illustrated example, the spout port 60 is formed on the rotary shaft 491 but is not limited thereto. The spout port 60 may be formed at a position above the floating plate 492-2 in the back plate 492-1, for example. The spouting of the liquid L1 from the spout port 60 can be performed by the control module 800 controlling an unillustrated valve, pump or the like provided in the supply flow path 50.

The substrate holder 440 is configured so that the liquid L1 spouted from the spout port 60 is supplied to the liquid holding portion 494L. The liquid L1 supplied to the liquid holding portion 494L coats at least a part of the contact member 494-4. The liquid L1 has a composition that is not particularly limited as long as the liquid is effective in protecting the contact member 494-4. It is preferable that the liquid L1 has a low electrical conductivity based on a predetermined threshold, such as having an electrical conductivity that is equal to or less than a predetermined threshold, or that the liquid is deaerated.

The electrical conductivity of the liquid L1 is preferably 50 μS/cm or less, and more preferably 10 μS/cm or less. If a liquid with a high electrical conductivity is present around the contact member 494-4 and the substrate Wf, metal components might accumulate and cause damages. Further, in addition to a current through a contact portion between the contact member 494-4 and the substrate Wf, a shunt current may flow through the liquid between the seed layer of the substrate Wf and the contact member 494-4 without passing through the contact portion. At this time, the seed layer may become thinner due to copper in the seed layer being ionized to dissolve, or the like. As the seed layer becomes thinner, an electrical resistance increases, and power supply variation might occur. If the electrical conductivity of the liquid L1 is low, such adverse effect can be suppressed. For details on the shunt current, refer to PTL 2 described above.

When a liquid containing oxygen is present around the contact member 494-4 and the substrate Wf, oxygen is ionized and a local battery effect might occur in which the seed layer dissolves in the liquid. For example, copper in the seed layer gives electrons to dissolved oxygen, to generate hydroxide ions from dissolved oxygen, and copper dissolves as copper ions. Due to the local battery effect, the seed layer becomes thinner, electrical resistance increases, and power supply variation might occur. When the liquid L1 is deaerated, such adverse effect can be suppressed. For details on the local battery effect, refer to PTL 2 described above.

From these viewpoints, it is preferable that the liquid L1 is pure water, deionized water, or deaerated water.

In the present embodiment, when the gap between the substrate holder 440 and the substrate Wf is sealed, the liquid holding portion 494L can hold the liquid L. The liquid holding portion 494L can hold more liquid L1 than the vicinity of a contact member in PTL 2, contaminant such as a plating solution in the vicinity of the contact member 494-4 is diluted into a lower concentration. Thus, the above-described adverse effect of the contaminant can be suppressed.

Figure 7:
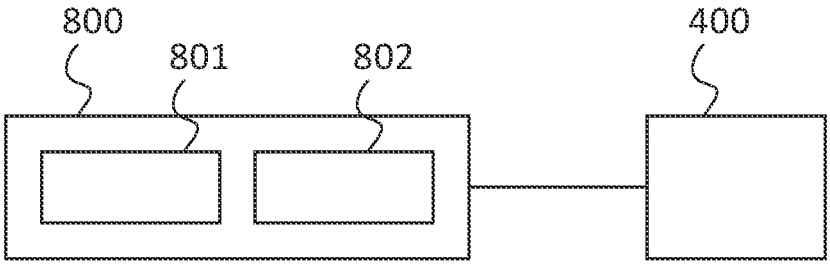
FIG. 7 is a conceptual diagram illustrating a configuration of a control module of the first embodiment.

FIG. 7 is a conceptual diagram for describing the control module 800. The control module 800 functions as a control device that controls an operation of the plating module 400. The control module 800 includes a computer such as a microcomputer, and this computer includes a CPU (central processing unit) 801 as a processor, a memory 802 as a temporary or non-transitory storage medium, and others. In the control module 800, the CPU 801 operates to control a part to be controlled of the plating module 400. The CPU 801 can perform various processes by executing a program stored in the memory 802 or by reading a program, stored in an unillustrated storage medium, into the memory 802 and executing the program. The program includes, for example, transfer control of the transfer robot or the transfer device, control of the process in each process module, control of the plating process in the plating module 400, a program that executes control of a process related to the liquid L1, and a program for detecting abnormalities in various types of equipment. As the storage medium, for example, a memory such as a computer-readable ROM, RAM or flash memory, a disk storage medium such as a hard disk, CD-ROM, DVD-ROM or a flexible disk or a known medium such as a solid state drive may be used. The control module 800 is configured to be able to communicate with an unillustrated host controller that supervises and controls the plating apparatus 1000 and other related devices and can exchange data with a database possessed by the host controller. Some or all of functions of the control module 800 can be configured in hardware such as an ASIC. Some or all of the functions of the control module 800 may be configured by a PLC, a sequencer, or the like. A part or all of the control module 800 can be disposed inside and/or outside a housing of the plating apparatus 1000. A part or all of the control module 800 is connected to be able to communicate with each part of the plating apparatus 1000 in a wired manner and/or a wireless manner.

FIGS. 8 to 13 are longitudinal sectional views illustrating a state of the substrate holder 440 in time series sequence for describing the plating method of the present embodiment. This plating method is performed by control of the control module 800.

Figure 8:
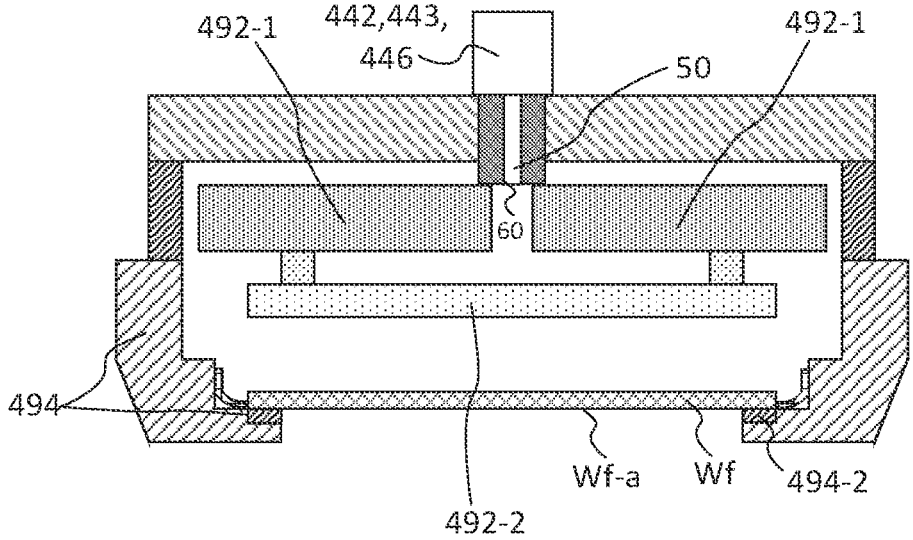
FIG. 8 is a longitudinal sectional view of the substrate holder for illustrating a plating method of the first embodiment.
Figure 9:
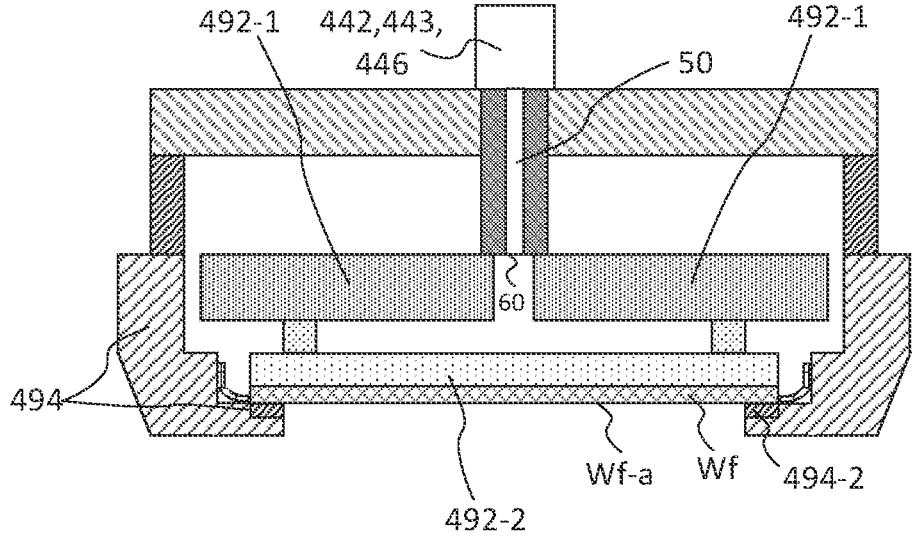
FIG. 9 is a longitudinal sectional view of the substrate holder for illustrating the plating method of the first embodiment.

FIGS. 8 and 9 schematically illustrate a step of attaching the substrate Wf to the substrate holder 440. FIG. 8 is a view illustrating a state where the substrate Wf is disposed on the support mechanism 494. In the illustrated example, the back plate assembly 492 including the floating plate 492-2 is elevated by the second elevating/lowering mechanism 443. Thus, the substrate Wf is disposed on the support member 494 in a state where a gap between the support member 494 and the floating plate 492-2 is wider.

FIG. 9 is a view illustrating a state where the substrate Wf is sealed. The back plate assembly 492 is lowered by the second elevating/lowering mechanism 443. The floating plate 492-2 presses the substrate Wf against the support member 494, and the gap between the substrate holder 440 and the substrate Wf is sealed.

Figure 10:
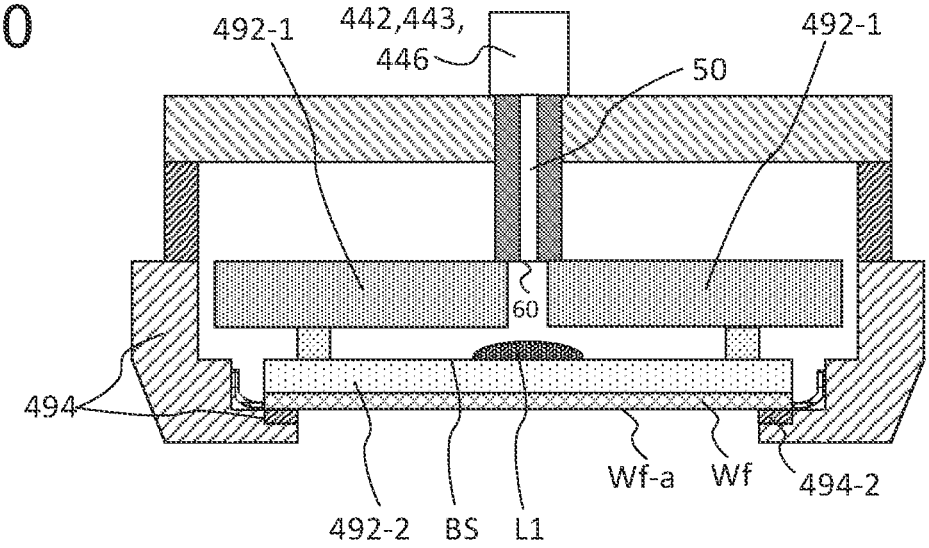
FIG. 10 is a longitudinal sectional view of the substrate holder for illustrating the plating method of the first embodiment.

FIG. 10 is a view schematically illustrating a step of spouting the liquid L1. The liquid L1 spouted from the spout port 60 above the floating plate 492-2 is disposed on a back surface BS of the floating plate 492-2. The back surface BS is a surface of the floating plate 492-2 that is opposite to a side on which the substrate Wf is disposed. Thus, when the substrate Wf is sealed with the sealing member 494-2, the control module 800 is configured to spout the liquid L1 to the liquid holding portion 494L or the space communicating with the liquid holding portion 494L through the spout port 60. Thereby, the liquid L1 can be stored in the liquid holding portion 494L in a state of being capable of holding the liquid L1, and a concentration of contaminant can be reduced, so that adverse effect of the contaminant on the contact member 494-4 or the like can be suppressed. Further, the liquid L1 is supplied to the contact member 494-4 after the substrate Wf is attached, so that the above adverse effect due to contamination of the plating solution in attaching the substrate Wf and contamination of the plating solution leaked from the sealing member 494-2 can be effectively suppressed. In the illustrated example, the spout port 60 is formed above the floating plate 492-2, so that the supply flow path 50 to the spout port 60 can be shortened and simplified. Further, in a configuration where the liquid L1 is spouted to the back surface BS, the liquid L1 can be supplied to the contact member 494-4 by use of the rotation mechanism 446.

Figure 11:
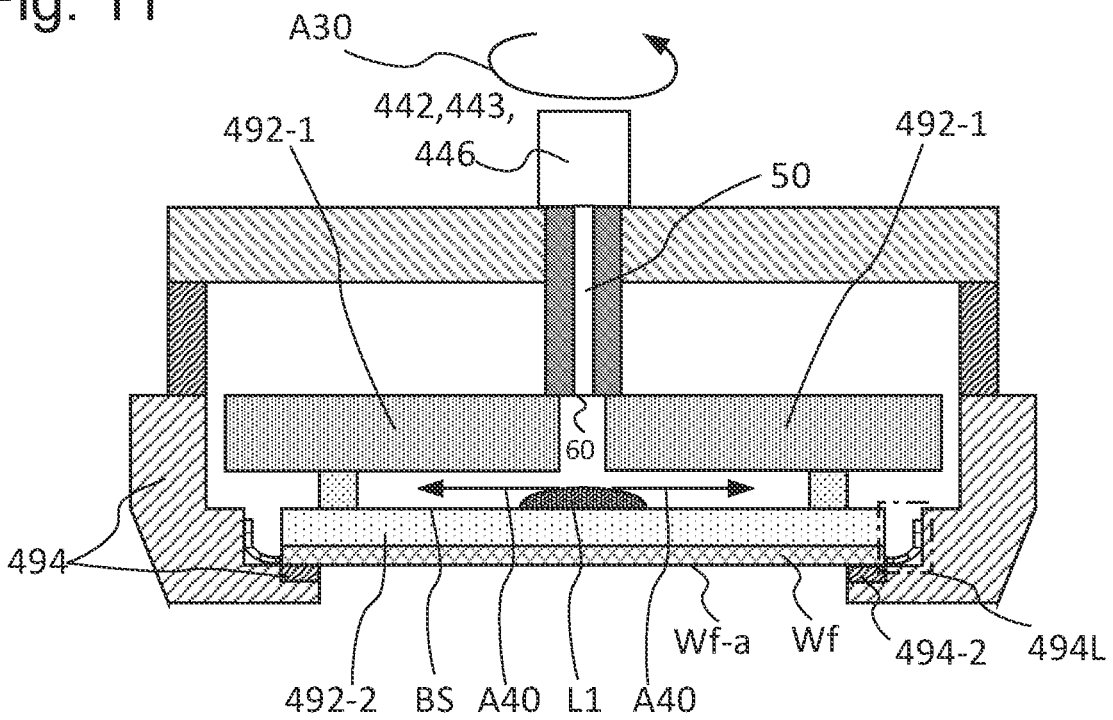
FIG. 11 is a longitudinal sectional view of the substrate holder for illustrating the plating method of the first embodiment.
Figure 12:
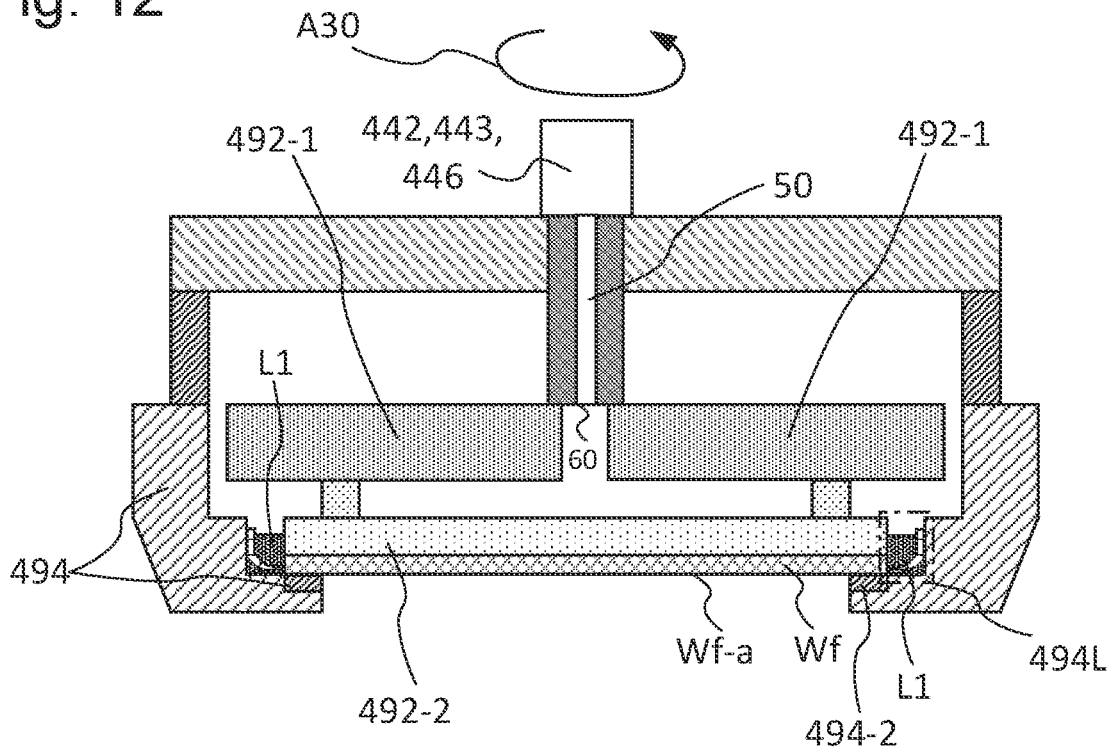
FIG. 12 is a longitudinal sectional view of the substrate holder for illustrating the plating method of the first embodiment.

FIGS. 11 and 12 are views schematically illustrating a step of rotating the substrate holder 440. The rotation mechanism 446 rotates the substrate holder 440 about an axis intersecting the surface to be plated Wf-a as a rotation axis (arrow A30). As illustrated in FIG. 11, due to a centrifugal force of this rotation, the liquid L1 on the back surface BS of the floating plate 492-2 moves outward in the radial direction (arrow A40). The liquid L1 moves to the liquid holding portion 494L formed outside the floating plate 492-2. FIG. 12 is a view illustrating that the movement during the rotation allows the liquid L1 to reach the liquid holding portion 494L and to be held in the liquid holding portion 494L. Further, this rotation allows the liquid L1 to be more uniformly distributed in the liquid holding portion 494L.

Figure 13:
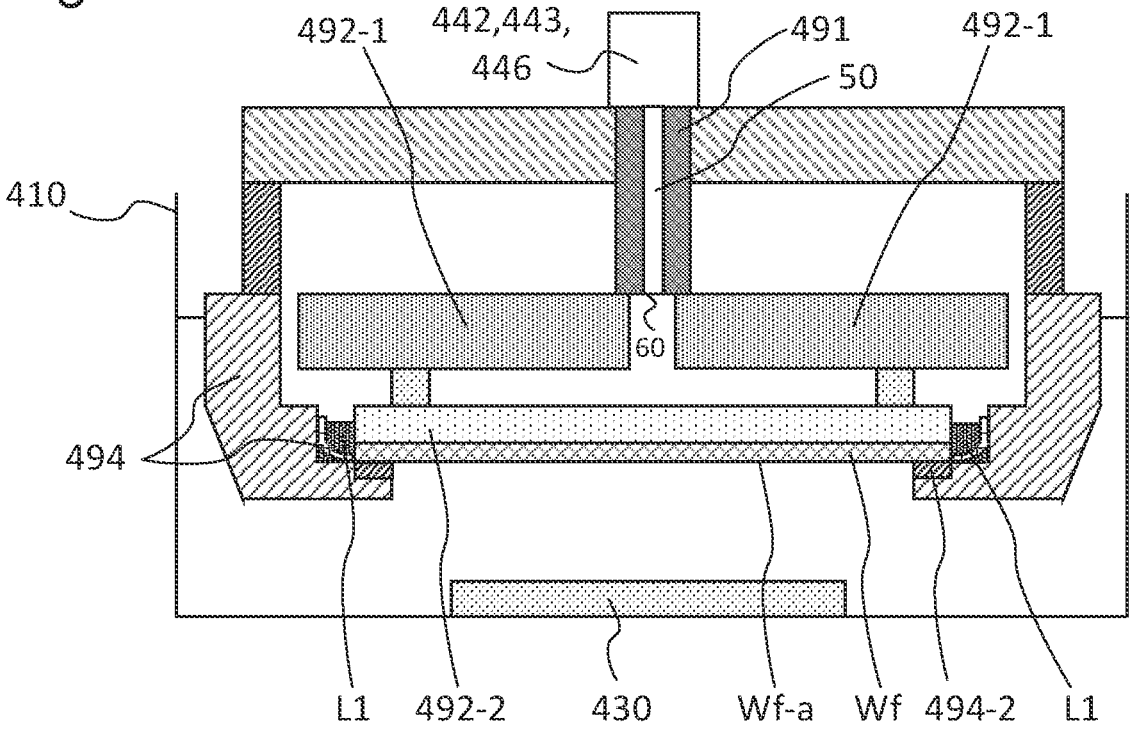
FIG. 13 is a longitudinal sectional view of the substrate holder for illustrating the plating method of the first embodiment.

FIG. 13 is a view schematically illustrating a step of immersing the substrate holder 440 in the plating solution and performing the plating process. The first elevating/lowering mechanism 442 lowers the substrate holder 440 toward the plating tank 410 to immerse at least the substrate Wf in the plating solution. While immersing the substrate Wf in the plating solution, a voltage is applied between the substrate Wf and the anode 430, and the plating process is performed. Even during the immersion and plating process of the substrate holder 440, the liquid L is held in the liquid holding portion 494L. When immersing the substrate holder 440 in the plating solution and performing the plating process, the rotation of the substrate holder 440 may be stopped, but from a viewpoint of making a thickness of plating to be formed uniform, it is preferable to rotate the holder at a predetermined rotation speed.

Figure 14:
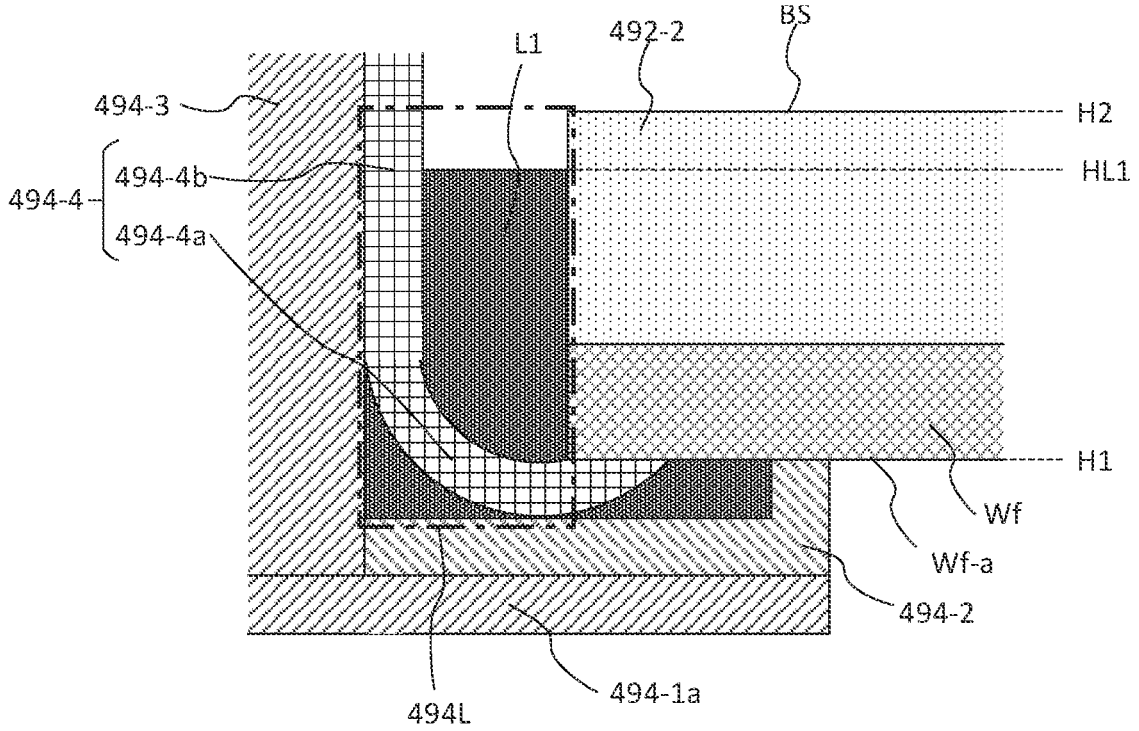
FIG. 14 is an enlarged sectional view schematically illustrating the liquid holding portion.

FIG. 14 is an enlarged sectional view of the substrate holder 440 schematically illustrating the liquid holding portion 494L holding the liquid L1. It is preferable that a height HL1 of a liquid level of the liquid L1 in the liquid holding portion 494L is between a height H1 of the surface to be plated Wf-a of the substrate Wf and a height H2 of the back surface BS of the floating plate 492-2. If the liquid level height HL1 of the liquid L1 is lower than the height H1, the contact member 494-4 cannot be sufficiently covered, and adverse effect of contaminant might occur. Further, a distance between the liquid level of the liquid L1 and the surface to be plated Wf-a is short, and hence oxidation of the seed layer due to oxygen dissolved from the liquid level might easily occur. If the liquid level height HL1 of the liquid L1 is higher than the height H2, the substrate holder might be inefficiently rotated due to a mass of the liquid L1, and additionally, when the substrate Wf is removed from the substrate holder 440, a large amount of liquid L1 might drop into and dilute the plating solution. It is preferable that the control module 800 is configured to spout a preset amount of liquid L1. This amount is preferably set such that in the liquid holding portion 494L, the liquid level of the liquid L1 is at a height between the surface to be plated Wf-a that is a lower surface of the substrate Wf and the back surface BS that is an upper surface of the floating plate 492-2.

Figure 15:
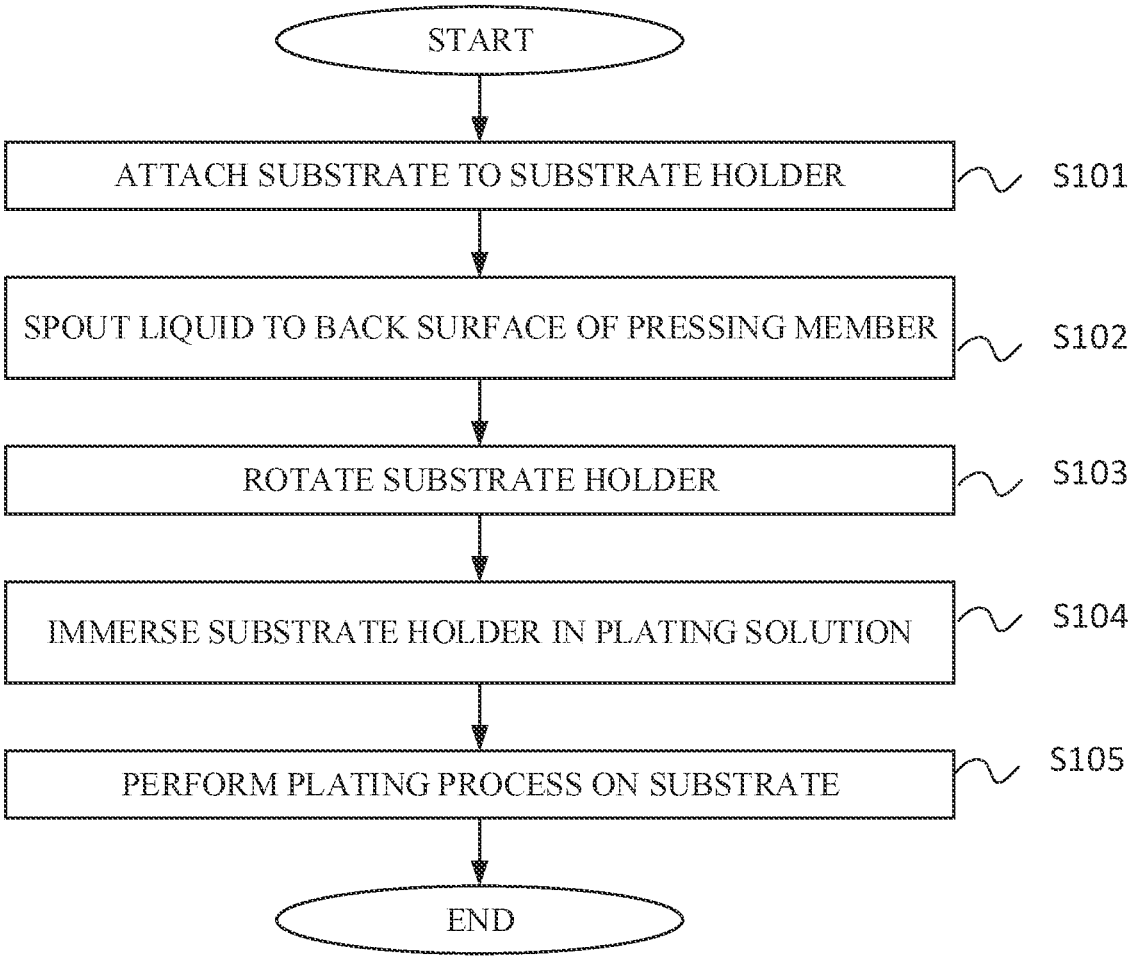
FIG. 15 is a flowchart illustrating a flow of the plating method of the first embodiment.

FIG. 15 is a flowchart illustrating a flow of the plating method of the present embodiment. In step S101, the substrate Wf is attached to the substrate holder 440. After step S101, step S102 is performed. In step S102, the liquid L1 is spouted to the back surface BS of the floating plate 492-2 that is the pressing member. After step S102, step S103 is performed. In step S103, the substrate holder 440 is rotated. After step S103, step S104 is performed. In step S104, the substrate holder 440 is immersed in the plating solution. After step S104, step S105 is performed. In step S105, the plating process is performed on the substrate Wf. After step S105, the substrate Wf is removed from the substrate holder 440 and transferred to the cleaning module 500.

The plating apparatus 1000 of the present embodiment includes the substrate holder 440 and the rotation mechanism 446, and the substrate holder 440 includes the liquid holding portion 494L including the contact member 494-4 inside and being configured to be able to hold the liquid L1 when the gap between the substrate holder 440 and the substrate Wf is sealed with the sealing member 494-2, and the spout port 60 configured to open into the liquid holding portion 494L or a space communicating with the liquid holding portion 494L in the substrate holder 440, to spout the liquid L1. Thereby, the plating apparatus 1000 capable of suppressing adverse effect of contaminant inside the substrate holder 440 on the contact member 494-4 or the like can be provided. Also, the amount of liquid L1 inside the substrate holder 440 can be regulated to efficiently perform the plating process. Furthermore, when supplying the liquid L1 to the contact member 494-4, risk of the liquid L1 dropping into and diluting the plating solution can be reduced than when injecting the liquid from the outside of the substrate holder into the contact member.

The plating method of the present embodiment is a plating method performed with the plating apparatus 1000 described above, and includes attaching the substrate Wf to the substrate holder 440, spouting the liquid L1 from the spout port 60, rotating the substrate holder 440 to move the spouted liquid L1 to the liquid holding portion 494L or to distribute the liquid L1 more uniformly in the liquid holding portion 494L, and performing the plating process on the attached substrate Wf. Thereby, it is possible to more reliably suppress adverse effect of contaminant inside the substrate holder 440 on the contact member 494-4 or the like.

The following modifications are also within the scope of the present invention and can be combined with the above-described embodiment or other modifications. In the following modifications, parts exhibiting the same structure, function, and the like as in the above-described embodiment are denoted with the same reference numeral, and description thereof is not repeated as appropriate.

(Modification 1-1)

In the above-described embodiment, a recess may be formed on the back surface of the floating plate that is a pressing member.

Figure 16:
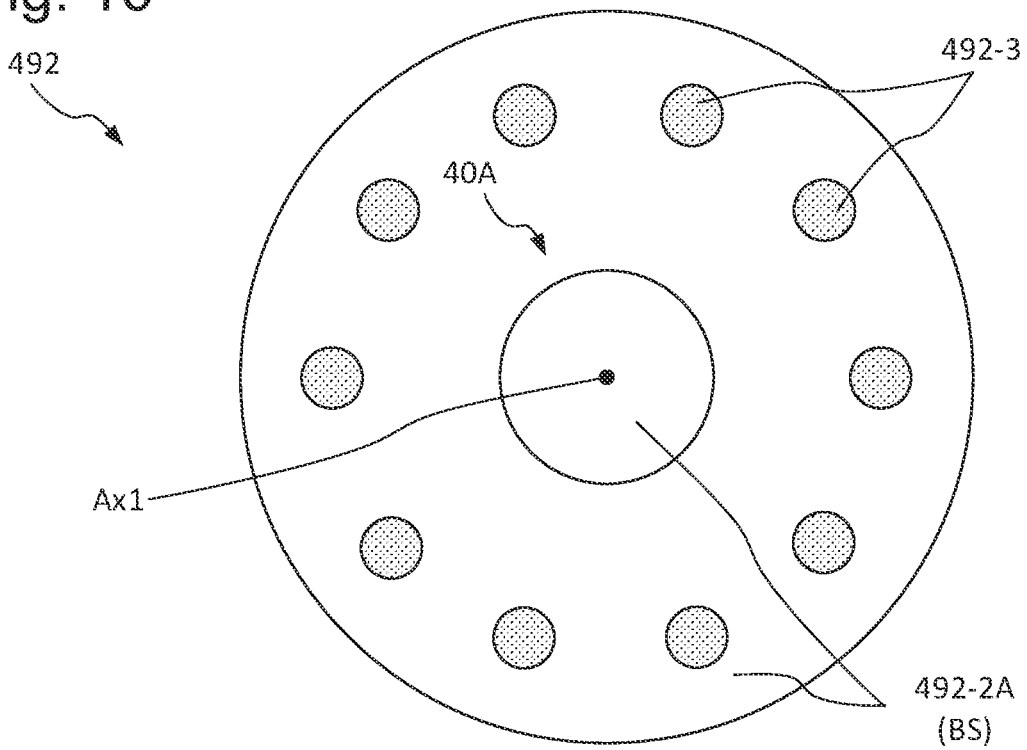
FIG. 16 is a plan view schematically illustrating a floating plate of Modification 1-1.

FIG. 16 is a transverse sectional view of a back plate assembly 492 schematically illustrating a back surface BS of a floating plate 492-2A of this modification. In an illustrated example, ten cylindrical pressing mechanisms 492-3 are arranged rotationally symmetrically on the back surface BS, but a shape, number and position of each pressing mechanism 492-3 are not particularly limited.

A recess 40A is formed in a central portion of the back surface BS of the floating plate 492-2A to surround a central axis Ax1 of the floating plate 492-2A. It is preferable that the central axis Ax1 is configured to substantially coincide with a rotation axis of a substrate holder 440. In the recess 40A, a liquid L1 that has dropped from a spout port 60 is temporarily held. The recess 40A holds the liquid L1 in the central portion until rotation by a rotation mechanism 446 (step S103 described above) is performed, to suppress bias of an amount of liquid L1 moving in each direction during the rotation. Thereby, the liquid L1 is distributed more uniformly in a liquid holding portion 494L.

(Modification 1-2)

In Modification 1-1, a radial recess may be formed on the back surface of the floating plate.

Figure 17:
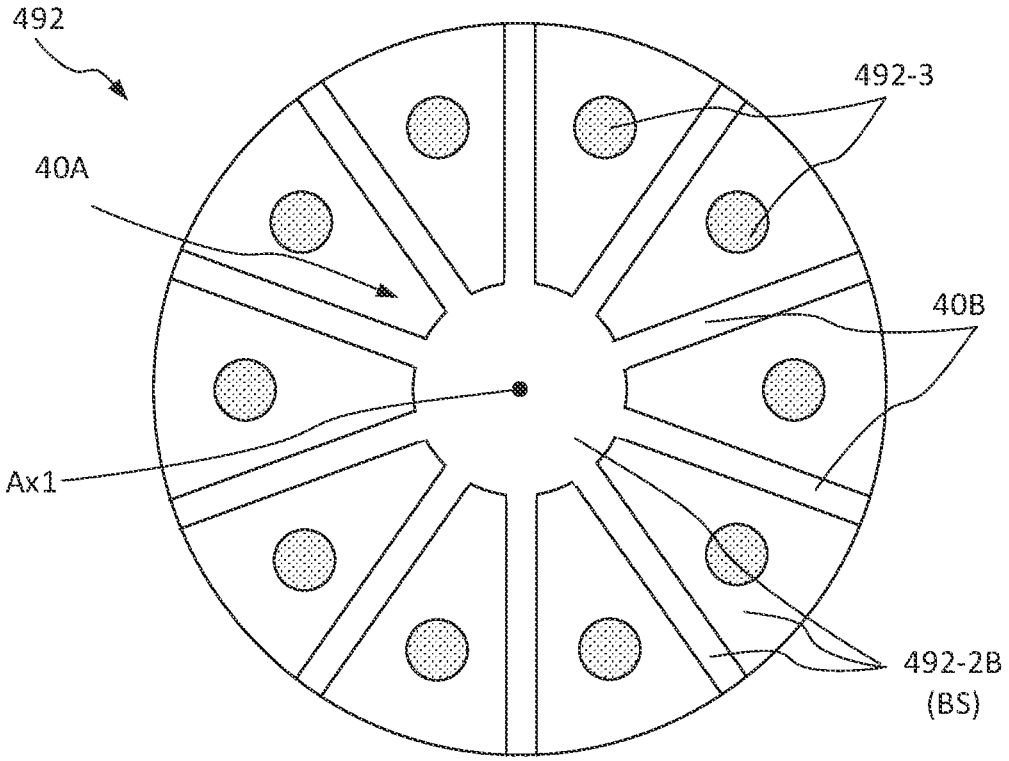
FIG. 17 is a plan view schematically illustrating a floating plate of Modification 1-2.

FIG. 17 is a transverse sectional view of a back plate assembly 492 schematically illustrating a back surface BS of a floating plate 492-2B of this modification. On the back surface BS of the floating plate 492-2B, a radially extending recess 40B is formed in addition to a recess 40A. A liquid L1 spouted from a spout port 60 can easily move radially through the recess 40B. Thereby, during rotation by a rotation mechanism 446 in step S103 described above, the bias of the amount of the liquid L1 moving in each direction can be more reliably suppressed.

In the plating apparatus of this modification, the recesses 40A and 40B for allowing the liquid L1 to flow or holding the liquid L1 are formed on the back surface BS of the floating plate 492-2B. Thereby, the bias of the amount of the liquid L1 moving in each direction can be suppressed, and the liquid L1 can be distributed more uniformly in a liquid holding portion 494L. Further, the movement of the liquid L1 to the liquid holding portion 494L can be smoothened and process efficiency can be increased. It should be noted that on the back surface BS, the recess 40B may be formed without the recess 40A.

(Modification 1-3)

In the above-described embodiment, further, the liquid L1 may be moved to the liquid holding portion 494L by tilting the substrate holder.

Figure 18:
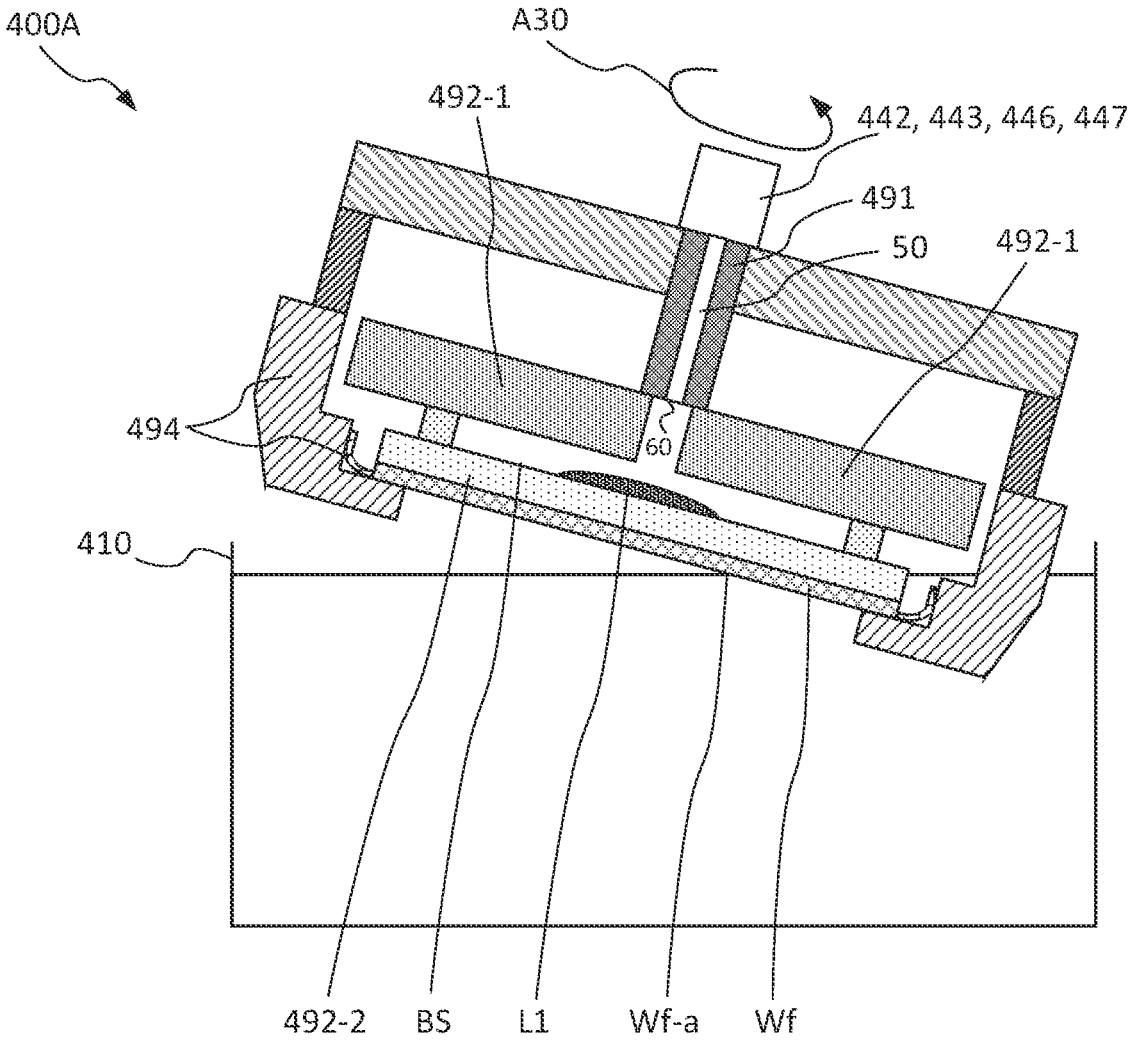
FIG. 18 is a longitudinal sectional view for illustrating a plating method of Modification 1-3.

FIG. 18 is a longitudinal sectional view schematically illustrating a plating module 400A for describing the plating method of this modification. The plating module 400A includes substantially the same configuration as the plating module 400 described above but differs in including a tilting mechanism 447. The tilting mechanism 447 is configured to tilt a substrate holder 440 and can be achieved by a known mechanism such as a tilt mechanism. Here, tilt of the substrate holder 440 refers to tilt of a substrate Wf that can be disposed on the substrate holder 440, and is represented by, for example, an angle formed by horizontal and a lower surface of a floating plate 492-2.

After spouting liquid L1 from a spout port 60 toward the floating plate 492-2, the control module 800 controls a rotation mechanism 446 and the tilting mechanism 447 to rotate the substrate holder 440 and to tilt the substrate holder 440 so that a back surface BS of the floating plate 492-2 tilts from the horizontal. Due to gravity, the liquid L1 is easy to move to the liquid holding portion 494L on a lower side of the tilt. Thereby, even when the liquid L1 is difficult to move due to rotation, the liquid L1 can be supplied to a contact member 494-4 more reliably. It is preferable from a viewpoint of more uniformly distributing the liquid L1 to the liquid holding portion 494L that the tilting mechanism 447 tilts the substrate holder 440 in a plurality of different orientations.

Further, as in the illustrated example, when the substrate holder 440 to which the substrate Wf is attached is immersed in the plating solution, the tilting mechanism 447 performs the tilting, to raise foam toward a liquid level due to the tilt, which makes it difficult for the foam to remain on the surface to be plated Wf-a. Then, disturbance of electric field due to the foam can be prevented and uniformity of the thickness of the formed plating can be reduced. In other words, the control module 800 can move the liquid L1 to the liquid holding portion 494L when tilting the substrate holder 440 so that foam does not enter the surface to be plated Wf-a.

Figure 19:
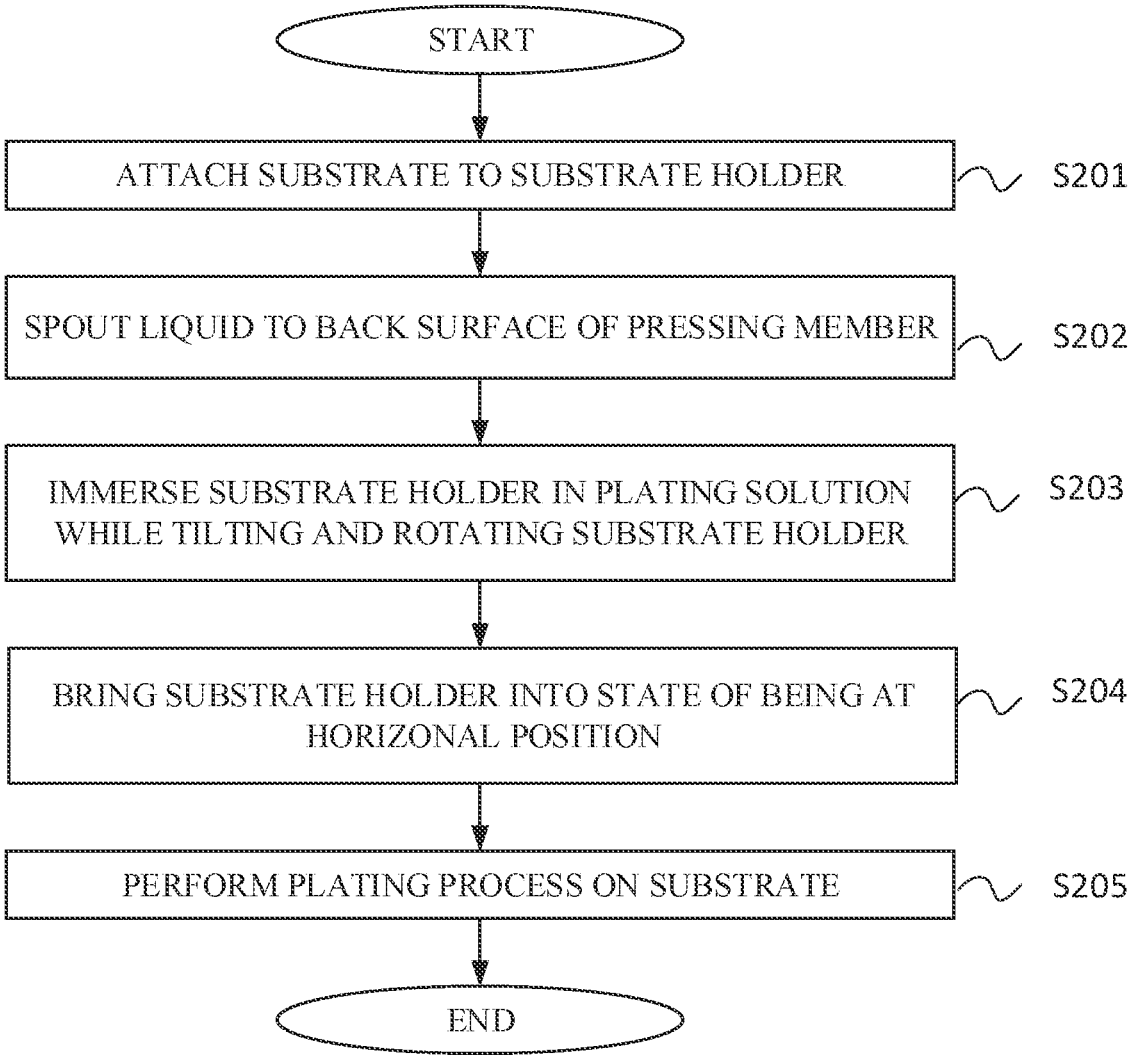
FIG. 19 is a flowchart illustrating a flow of the plating method of Modification 1-3.

FIG. 19 is a flowchart illustrating a flow of the plating method of this modification. This plating method is performed by the control module 800. Steps S201, S202 and S205 are the same as steps S101, S102 and S105 of the flowchart of FIG. 15 described above, and hence description thereof is not repeated. After step S202, step S203 is performed. In step S203, the substrate holder 440 is immersed in the plating solution while the tilting mechanism 447 and the rotation mechanism 446 tilt and rotate the substrate holder 440. After step S203, step S204 is performed. In step S204, the tilting mechanism 447 brings the substrate holder 440 into a state of being at a horizontal position. Here, the horizontal position is an orientation of the substrate holder 440 in which the surface to be plated Wf-a is substantially horizontal to such an extent that the plating can be formed uniformly to a desired degree. After step S204, step S205 is performed.

(Modification 1-4)

In the above-described embodiment, liquid may be spouted from the outside of the substrate holder and the liquid may be disposed on the back surface of the floating plate.

Figure 20:
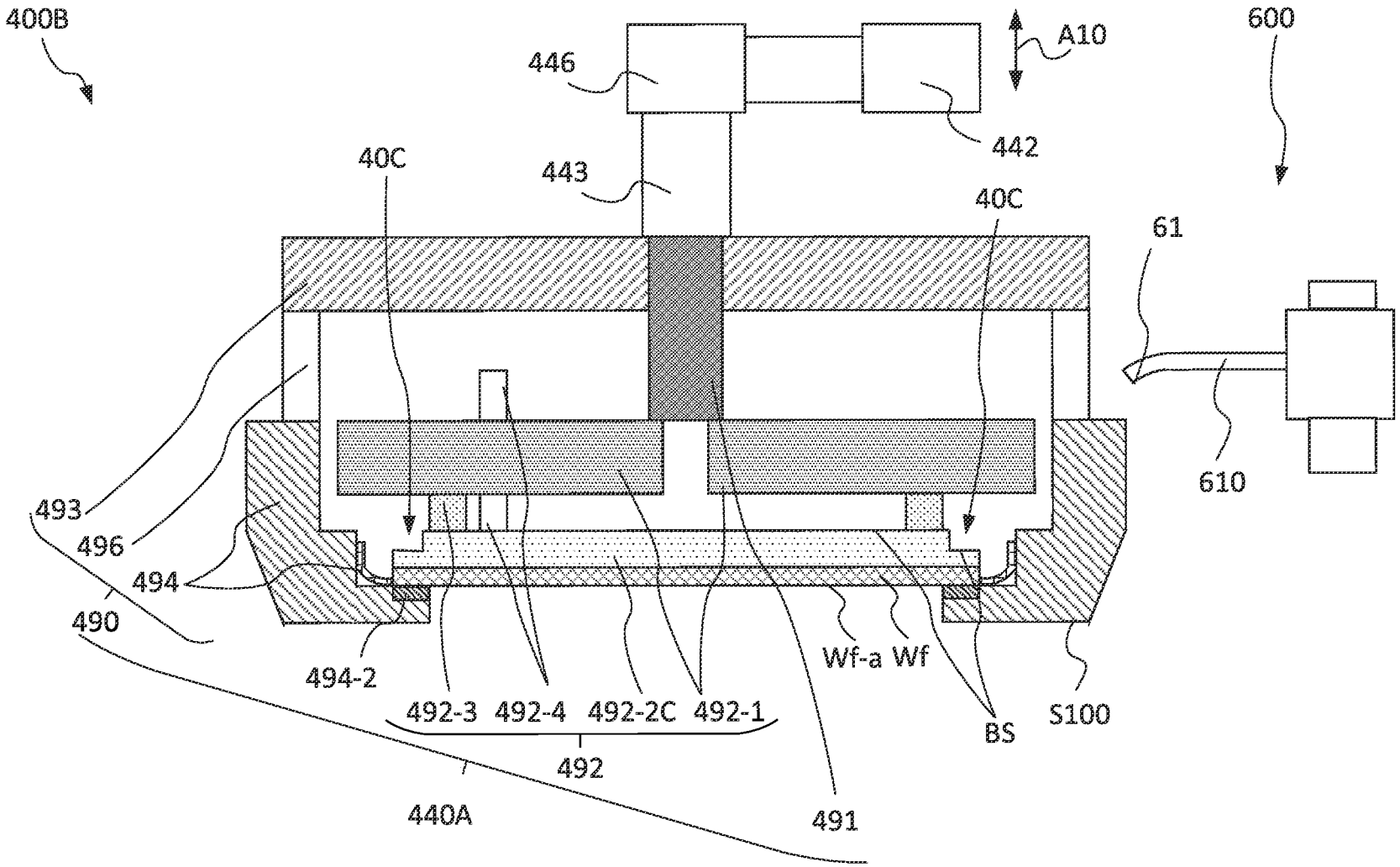
FIG. 20 is a longitudinal sectional view schematically illustrating a plating module of Modification 1-4.

FIG. 20 is a longitudinal sectional view schematically illustrating a plating module 400B of this modification. The plating module 400B includes substantially the same configuration as the plating module 400 of the above-described embodiment but is different from the plating modules 400 described above in including a substrate holder 440A instead of the substrate holder 440, and further including a liquid supply device 600. The substrate holder 440A includes substantially the same configuration as the substrate holder 440 but is different from the substrate holder 440 in including a floating plate 492-2C instead of the floating plate 492-2 and in that the supply flow path 50 and the spout port 60 are not formed.

The liquid supply device 600 is configured to supply liquid L1 to the floating plate 492-2C. The liquid supply device 600 includes a nozzle 610 in which a spout port 61 for spouting the liquid L1 is formed. The nozzle 610 is configured to be able to spout the liquid L1 from the outside of the substrate holder 440A toward a recess 40C described later when a back plate 492-1 is elevated. In an illustrated example, the liquid L1 spouted from the nozzle 610 flows between a plurality of columnar second upper members 496 arranged on outer peripheral portions of a first upper member 493 and a support member 494, to enter the substrate holder 440A. It is preferable that the spout port 61 can be disposed on a side of the substrate holder 440A. In other words, the spout port 61 is disposed on the side of the substrate holder 440A or movable on the side of the substrate holder 440A. Further, from a viewpoint of making it easier for the liquid L1 to reach the recess 40C, it is preferable that the spout port 61 can be disposed on the side of the substrate holder 440A and above a bottom surface S100 of the substrate holder 440A and further preferably, can be disposed above the highest reach position of the back surface BS of the floating plate 492-2C. Thus, the liquid supply device 600 is provided with the spout port 61 for spouting the liquid L1 toward the recess 40C.

Figure 21:
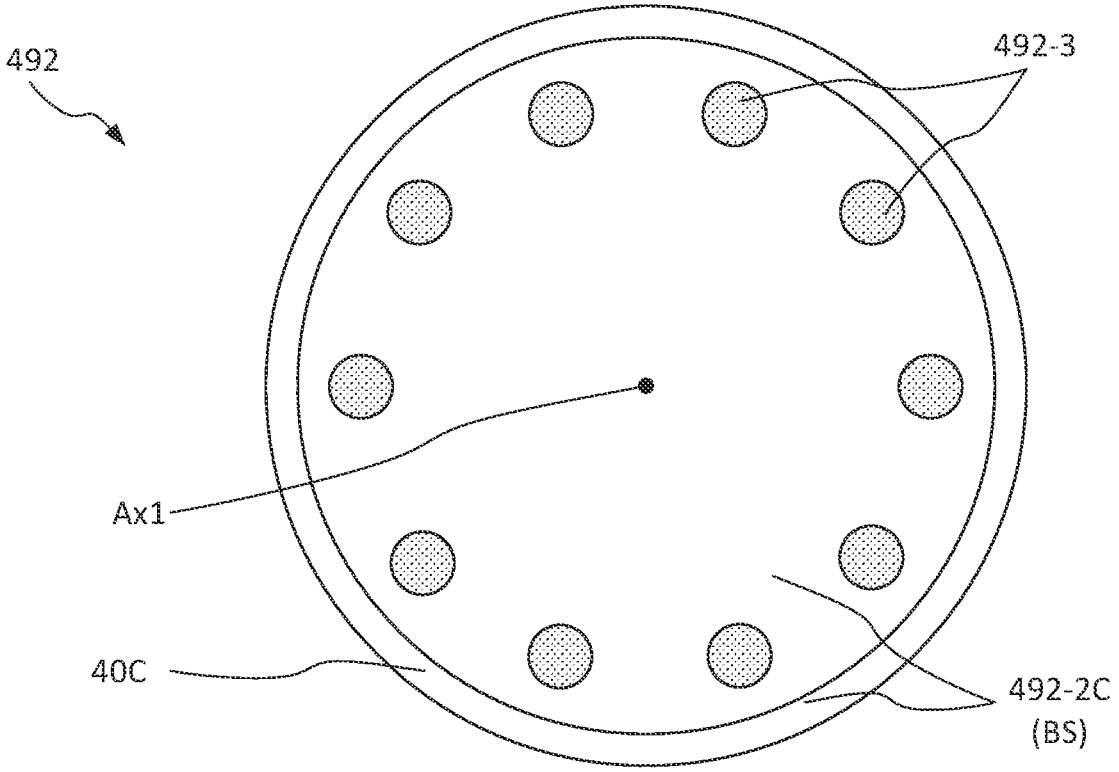
FIG. 21 is a plan view schematically illustrating a floating plate of Modification 1-4.

FIG. 21 is a plan view schematically illustrating the back surface BS of the floating plate 492-2C of this modification. The floating plate 492-2C includes substantially the same configuration as the floating plate 492-2A of the above-described modification but is different in that the recess 40C is formed instead of the recess 40A. The recess 40C is formed on the outer peripheral portion of the floating plate 40C. This facilitates introducing of the liquid L1 into the recess 40C from the outside of the substrate holder 440A.

Figure 22:
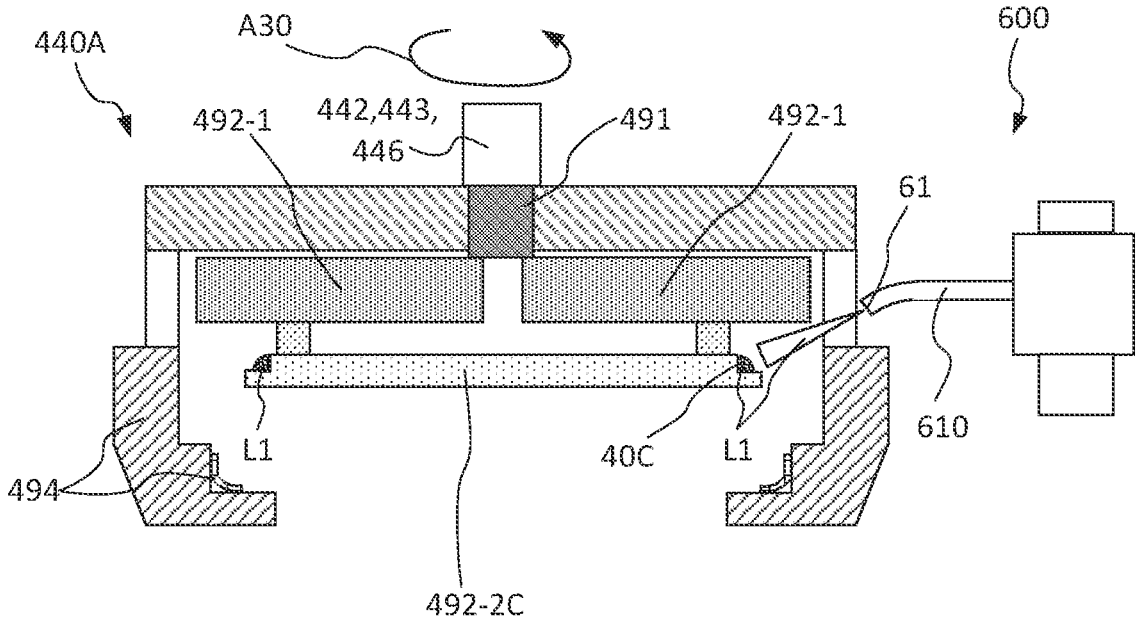
FIG. 22 is a longitudinal sectional view of a substrate holder for illustrating a plating method of Modification 1-4.
Figure 23:
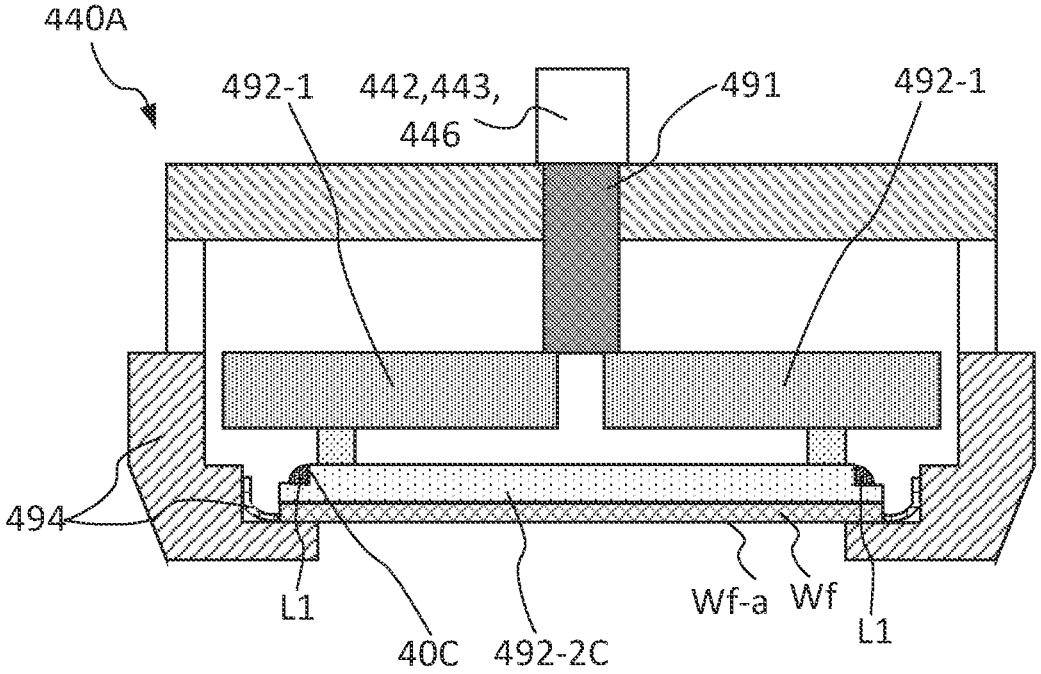
FIG. 23 is a longitudinal sectional view of the substrate holder for illustrating the plating method of Modification 1-4.
Figure 24:
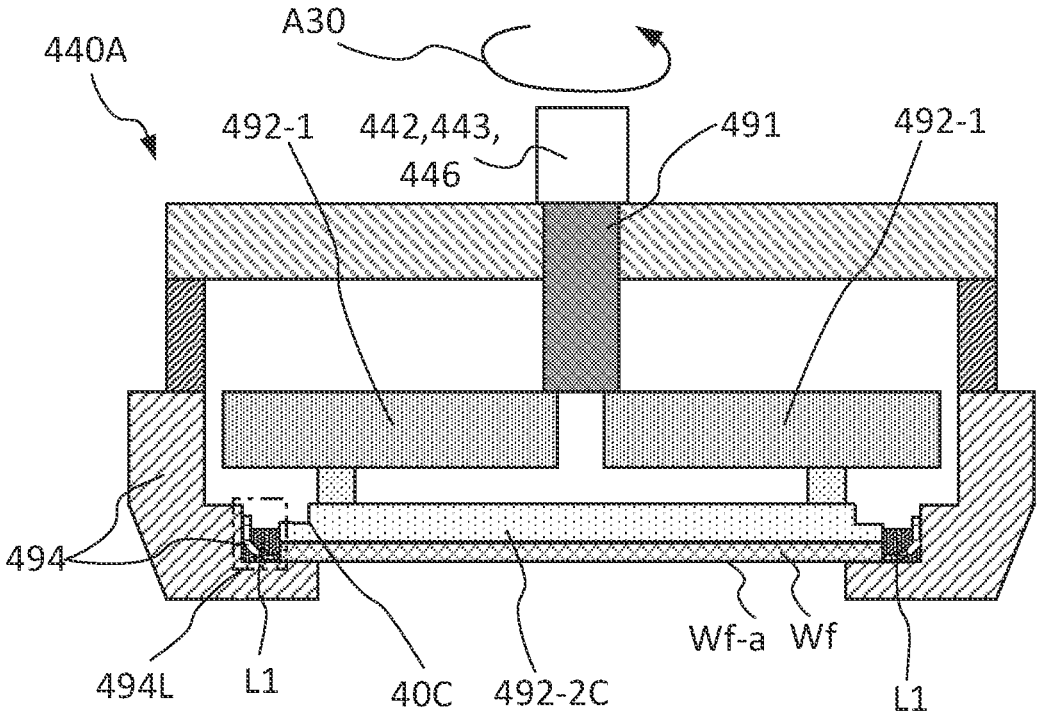
FIG. 24 is a longitudinal sectional view of the substrate holder for illustrating the plating method of Modification 1-4.

FIGS. 22 to 24 are longitudinal sectional views illustrating a state of the substrate holder 440A in time series sequence for describing the plating method of this modification. This plating method is performed under control of the control module 800.

FIG. 22 is a view schematically illustrating a step of disposing the liquid L1 inside the substrate holder 440A. When the second elevating/lowering mechanism 443 moves the back plate assembly 492 apart from the sealing member 494-2, the liquid L1 is spouted from the spout port 61 of the nozzle 610 toward the recess 40C. At this time, it is preferable that the substrate holder 440A is rotated by the rotation mechanism 446 to distribute the liquid L1 over an entire circumference as much as possible. Alternatively, the liquid supply device 600 may move to spout the liquid L1 toward different positions in the recess 40C.

FIG. 23 is a view schematically illustrating a step of attaching the substrate Wf to the substrate holder 440A in which the liquid L1 is disposed. The substrate Wf is disposed on the support member 494, and the second elevating/lowering mechanism 443 lowers the back plate assembly 492, so that a gap between the substrate holder 440A and the substrate Wf is sealed. In the recess 40C of the floating plate 492-2C, the liquid L1 remains in place.

FIG. 24 is a view schematically illustrating a step of moving the liquid L1 present in the recess 40C to the liquid holding portion 494L. When the rotation mechanism 446 rotates the substrate holder 440A, the liquid L1 is moved by a centrifugal force outward in the radial direction from the recess 40C disposed on the outer peripheral portion of the floating plate 492-2C and is held in the liquid holding portion 494L.

In the plating apparatus and plating method of this modification, the spout port 61 for spouting the liquid L1 is disposed outside the substrate holder 440A, and the control module 800 is configured to spout the liquid L1 from the spout port 61 outside the substrate holder 440A toward the floating plate 492-2C. Thereby, it is not necessary to provide a supply flow path for spouting the liquid L1 in the substrate holder 440A, and the liquid L1 can be supplied into the substrate holder 440A with a simpler configuration.

(Modification 1-5)

In the above-described embodiment, the inside of the substrate holder may be cleaned with the liquid L1 spouted into the substrate holder.

Figure 25:
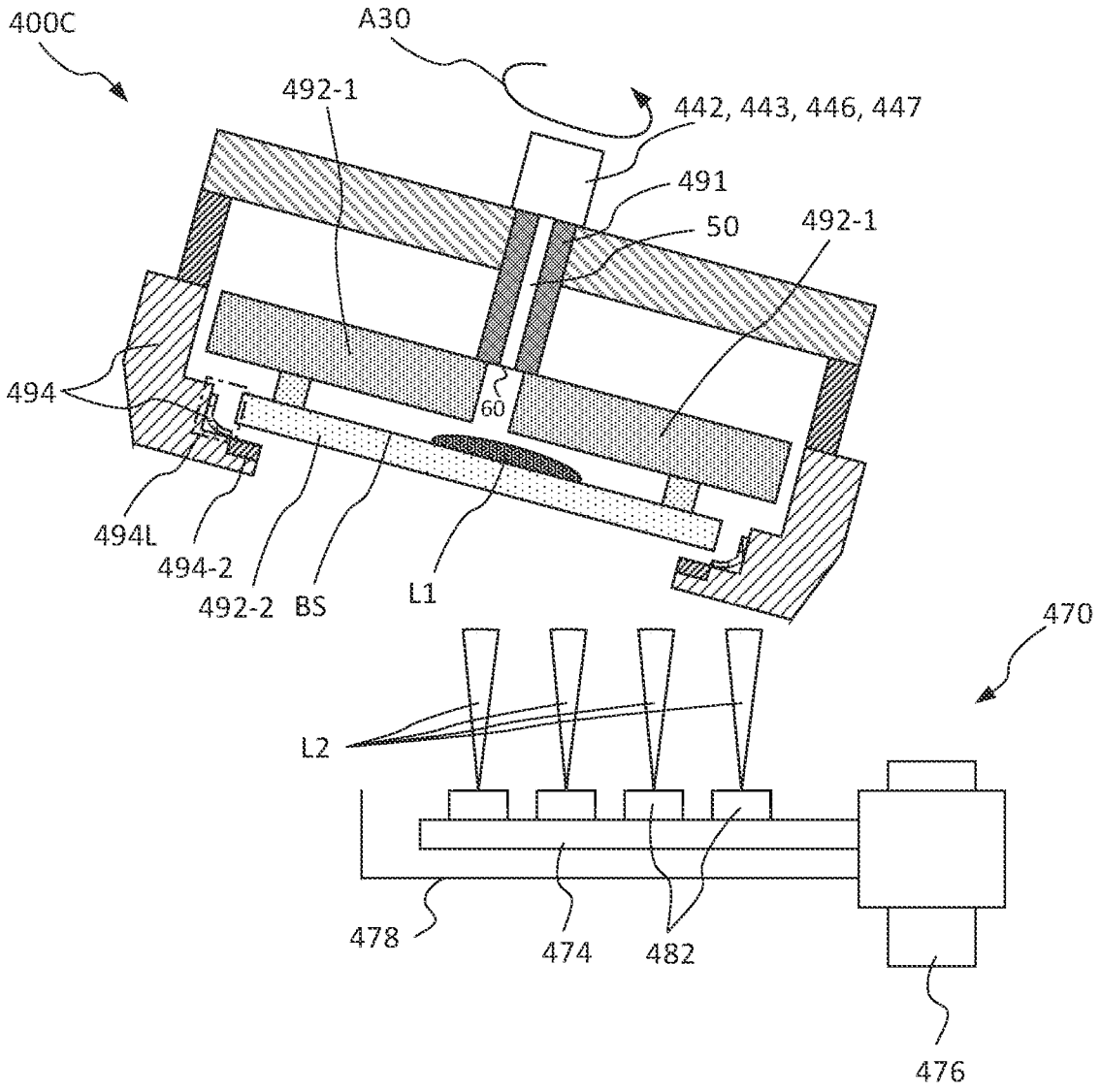
FIG. 25 is a longitudinal sectional view schematically illustrating a plating module of Modification 1-5.

FIG. 25 is a conceptual diagram illustrating a plating module 400C of this modification. The plating module 400C includes the same configuration as the plating module 400A of the above-described modification but is different from the plating module 400A in including a cleaning device 470. The cleaning device 470 includes an arm 474 and cleaning nozzles 482.

Each cleaning nozzle 482 spouts liquid L2 that is a cleaning solution. The liquid L2 may be pure water, deaerated water or the like, and may have the same composition as the liquid L1 or a different composition therefrom. An unillustrated pipe is connected to the cleaning nozzle 482, and the cleaning nozzle 482 spouts the liquid L2 introduced and supplied via the pipe from an unillustrated liquid source. In the illustrated example, the cleaning nozzle 482 is a nozzle that spouts liquid L1 to spread the liquid along a plane, but the cleaning nozzle 482 may be a straight nozzle that spouts the liquid L1 in substantially the same direction.

The cleaning device 470 includes a drive mechanism 476 configured to turn the arm 474. The drive mechanism 476 can be achieved by a known mechanism such as a motor. The arm 474 is a plate-shaped member extending from the drive mechanism 476 in the horizontal direction. The cleaning nozzle 482 is held on the arm 474. The drive mechanism 476 turns the arm 474 to move the cleaning nozzle 482 between a cleaning position between the plating tank 410 and the substrate holder 440 and a retracted position retracted from between the plating tank 410 and the substrate holder 440.

The cleaning device 470 includes a tray member 478 disposed below the cleaning nozzle 482. The tray member 478 is configured to receive the dropped liquid L2 spouted from the cleaning nozzle 482 to contact the substrate holder 440. In this modification, the cleaning nozzle 482 and the arm 474 are housed in the tray member 478. The drive mechanism 476 is configured to turn the cleaning nozzle 482, the arm 474, and the tray member 478 together between the cleaning position and the retracted position. However, the drive mechanism 476 may be able to drive the cleaning nozzle 482 and arm 474, and the tray member 478 separately.

In a method for cleaning the substrate holder 440 of this modification, after spouting the liquid L1 from the spout port 60 into the substrate holder 440 to which the substrate Wf is not attached, the liquid L1 is moved inside the substrate holder 440 by at least one of the rotation of the substrate holder 440 by the rotation mechanism 446 and the tilting of the substrate holder 440 by the tilting mechanism 447. By this movement, the back surface BS of the floating plate 492-2, the contact member 494-4, the liquid holding portion 494L, the sealing member 494-2 and the like can be cleaned. After cleaning the inside of the substrate holder 440, the liquid L1 drops from between the floating plate 492-2 and the sealing member 494-2 to the tray member 478 and is therefore inhibited from diluting the plating solution. On the other hand, the surface of the floating plate 492-2 on a side on which the substrate Wf is disposed and the support member 494 are cleaned with the liquid L2 spouted from the cleaning nozzle 482. The liquid L1 and liquid L2 that have dropped into the tray member 478 are discharged through an unillustrated pipe. It should be noted that the liquid L2 spouted from the cleaning nozzle 482 need not be used, and the liquid L1 spouted from the spout port 60 may be used to perform cleaning.

In this modification, the control module 800 is configured to spout the liquid L1 from the spout port 60 when the substrate Wf is not attached to the substrate holder 440, to clean at least one of the back surface BS, the contact member 494-4, the liquid holding portion 494L and the sealing member 494-2. This makes it possible to suppress damages on the contact member 494-4 and the like due to contaminant such as a plating solution, even after the substrate Wf is removed.

Figure 26:
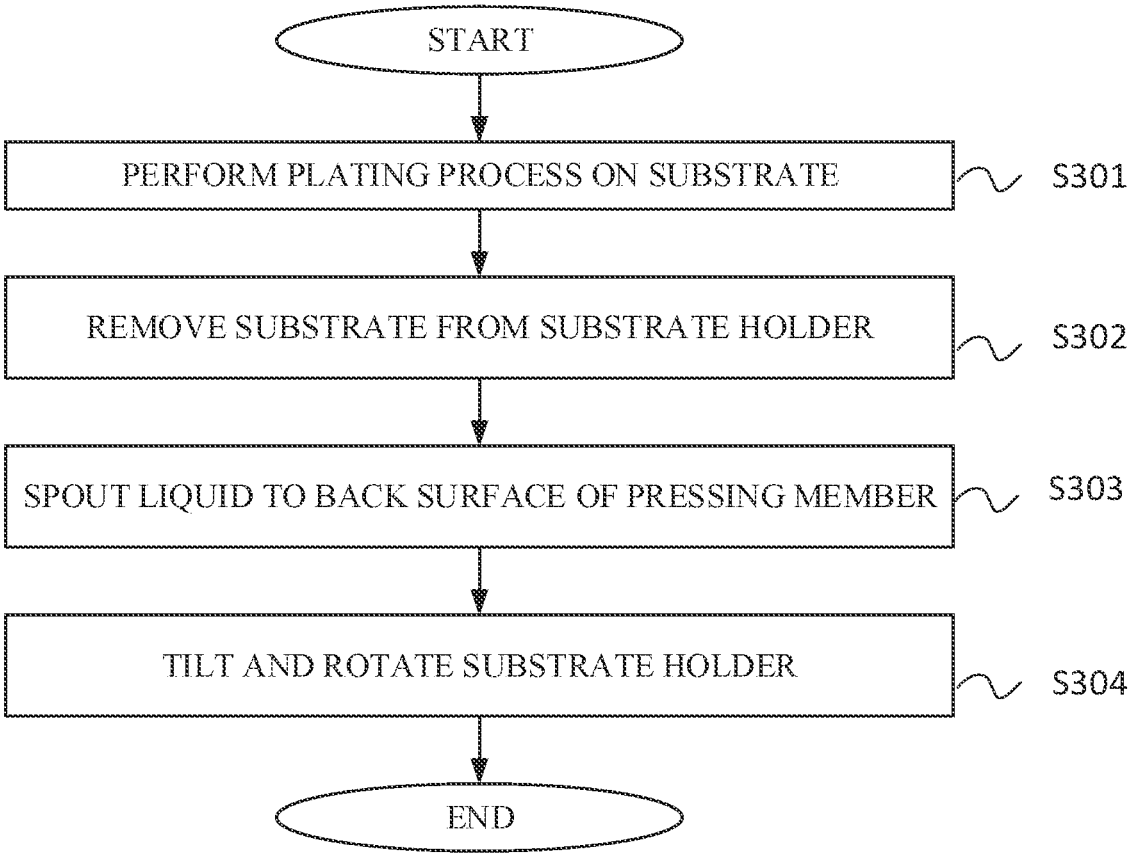
FIG. 26 is a flowchart illustrating a flow of a plating method of Modification 1-5.

FIG. 26 is a flowchart illustrating a flow of the plating method of this modification. In step S301, a plating process is performed on the substrate Wf. After step S301, step S302 is performed. In step S302, the substrate Wf is removed from the substrate holder 440. After step S302, step S303 is performed. In step S303, the liquid L1 is spouted to the back surface BS of the floating plate 492-2 that is the pressing member. After step S303, step S304 is performed. In step S304, the tilting mechanism 447 or the rotation mechanism 446 tilts or rotates the substrate holder 440. After step S304, the process is ended.

(Modification 1-6)

In the above-described embodiment, the support member of the substrate holder may be provided with an inclined surface for discharging liquid to the outside of the substrate holder.

Figure 27:
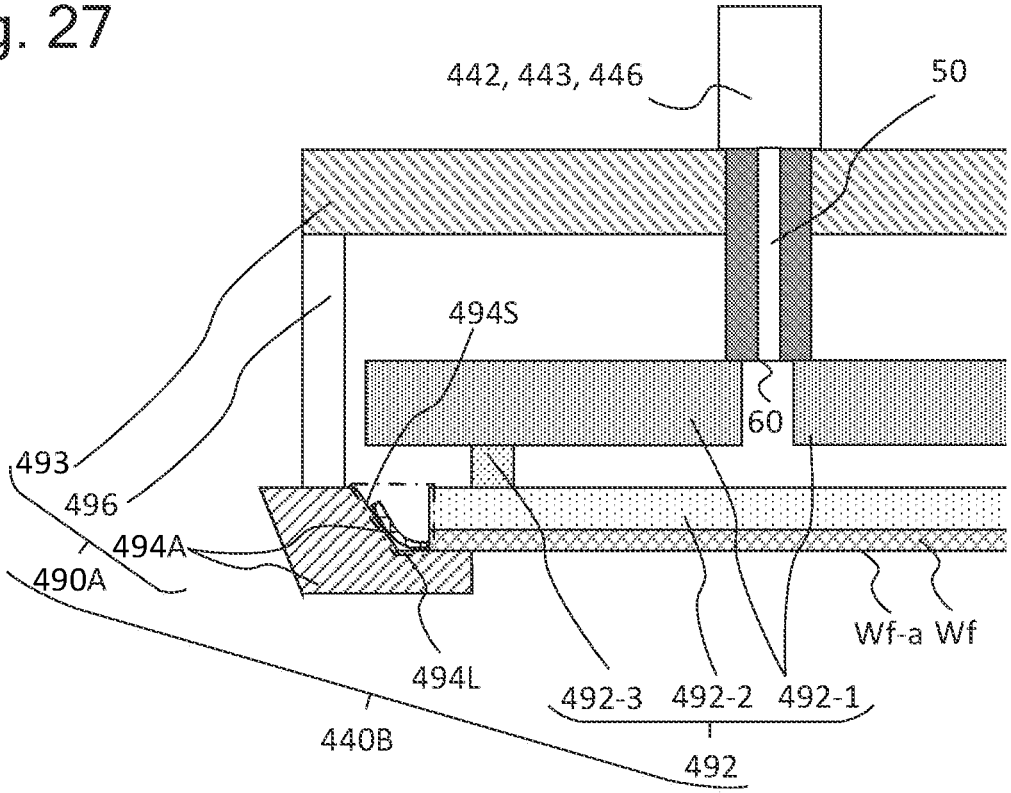
FIG. 27 is a longitudinal sectional view schematically illustrating a substrate holder of Modification 1-6.

FIG. 27 is a longitudinal sectional view schematically illustrating a substrate holder 440B of this modification. The substrate holder 440B includes substantially the same configuration as the substrate holder 440 of the above-described embodiment but is different from the substrate holder 440 in including a support member 494A instead of the support member 494. The support member 494A includes substantially the same configuration as the support member 494 described above but is different from the support member 494 in that an inclined surface 494S is formed on an inner lateral surface constituting a side wall of a liquid holding portion 494L. The inclined surface 494S is formed to increase in height outward in the radial direction, to discharge the liquid L1 outward in the radial direction more easily than a vertically extending side surface.

Figure 28:
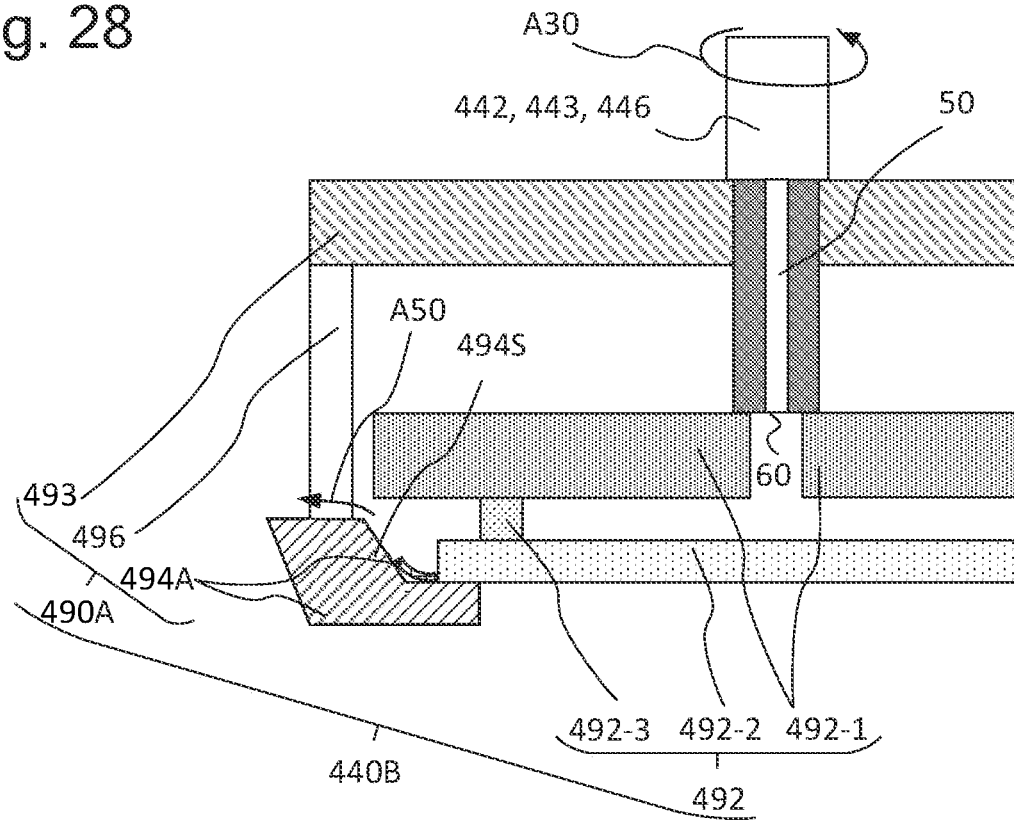
FIG. 28 is a longitudinal sectional view of the substrate holder for illustrating a plating method of Modification 1-6.

FIG. 28 is a longitudinal sectional view schematically illustrating a method for cleaning the substrate holder 440B of this modification. When the floating plate 492-2 is lowered and in contact with the sealing member 494-2, liquid L1 is spouted from the spout port 60, and then rotation by the rotation mechanism 446 is performed. The liquid L1 on the back surface BS of the floating plate 492-2 is moved outward in the radial direction by a centrifugal force of rotation, flows beyond the inclined surface 494S of the liquid holding portion 494L, and is discharged through the columnar second upper members 496 to the outside of the substrate holder 440B (arrow A50). Thereby, the liquid L1 flows smoothly outward in the radial direction, and hence the contact member 494-4 can be efficiently cleaned.

Figure 29:
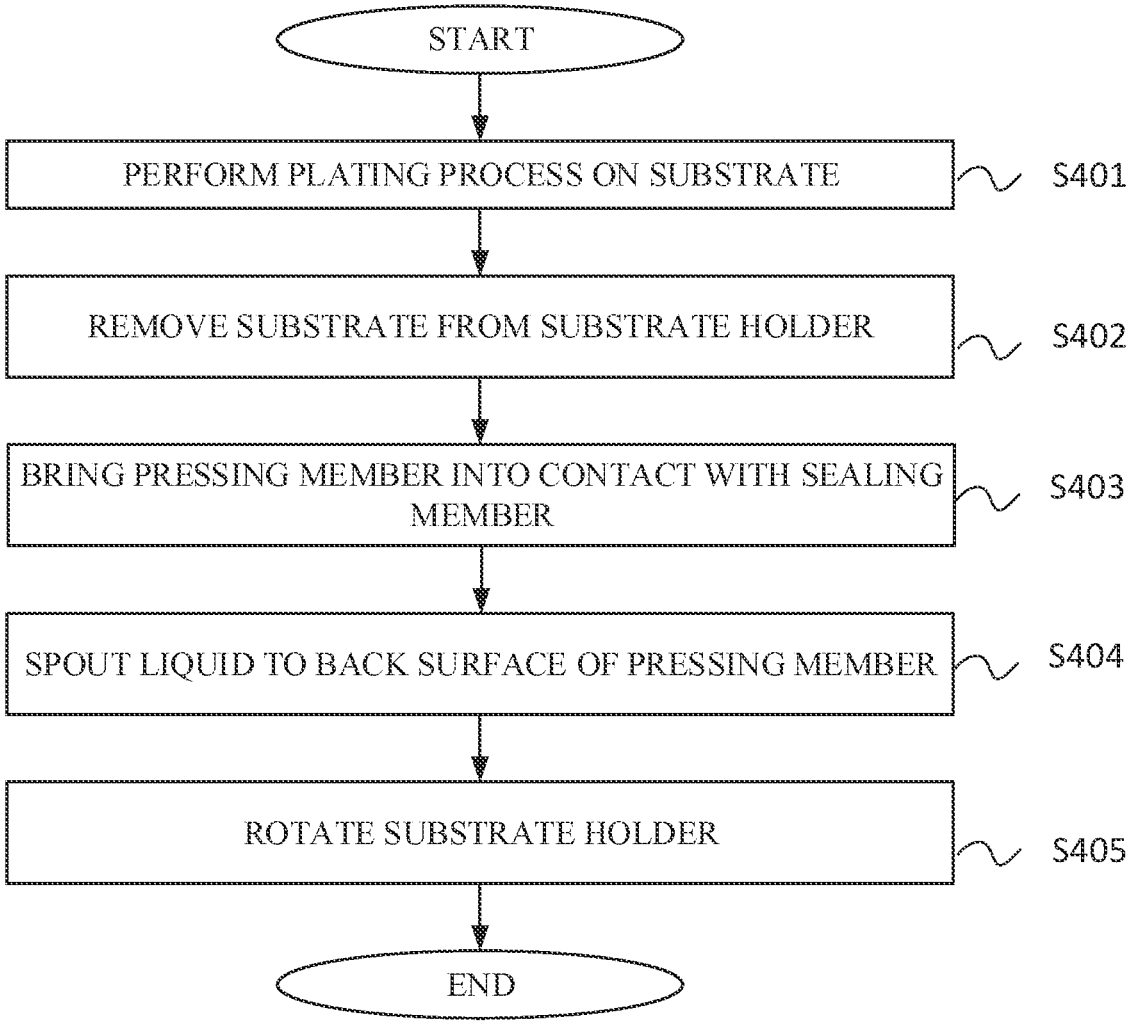
FIG. 29 is a flowchart illustrating a flow of the plating method of Modification 1-6.

FIG. 29 is a flowchart illustrating a flow of a plating method including the method for cleaning the substrate holder 440B of this modification. This plating method is performed by the control module 800. In step S401, a plating process is performed on the substrate Wf. After step S401, step S402 is performed. In step S402, the substrate Wf is removed from the substrate holder 440B. After step S402, step S403 is performed. In step S403, the floating plate 492-2 that is a pressing member is brought into contact with the sealing member 494-2. After step S403, step S404 is performed. In step S404, the liquid L1 is spouted to the back surface BS of the floating plate 492-2. After step S404, step S405 is performed. In step S405, the rotation mechanism 446 rotates the substrate holder 440B. After step S405, the process is ended.

Second Embodiment

A plating apparatus of a second embodiment includes the same configuration as the plating apparatus 1000 of the first embodiment described above but is different from the plating apparatus 1000 in including a plating module 4000 instead of the plating module 400. Hereinafter, parts illustrating the same structure, function, and the like as in the above-described embodiment will be denoted with the same reference signs, and description is not repeated as appropriate.

Figure 30:
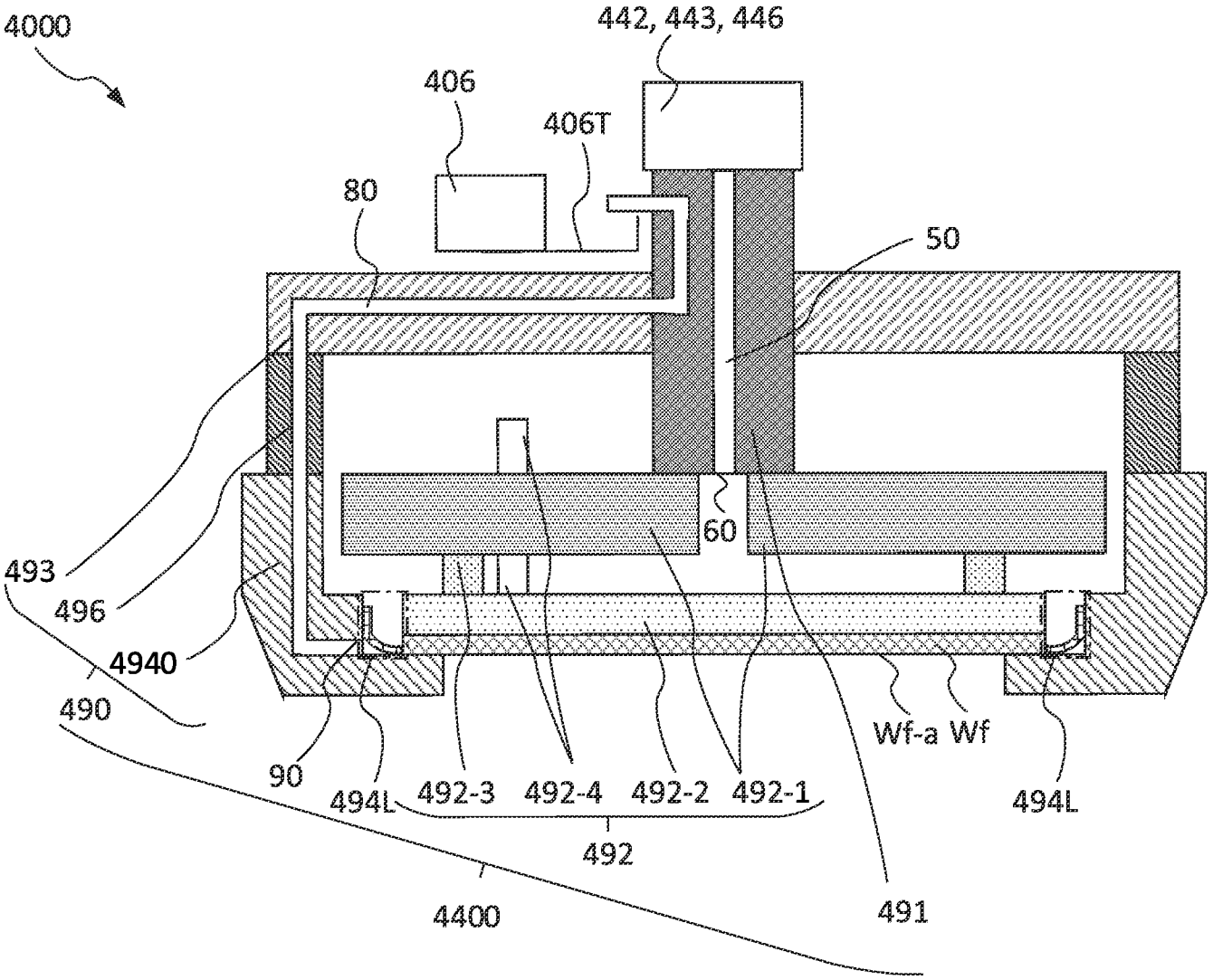
FIG. 30 is a longitudinal sectional view schematically illustrating a plating apparatus of a second embodiment.

FIG. 30 is a longitudinal sectional view schematically illustrating the plating module 4000 of the present embodiment. The plating module 4000 includes the same configuration as the plating module 400 described above but is different from the plating module 400 described above in including a substrate holder 4400 instead of the substrate holder 440, and in further including an electrical conductivity meter 406 and a tray 406T.

The substrate holder 4400 includes the same configuration as the substrate holder 440 described above but is different from the substrate holder 440 in that a discharge port 90 configured to open into a liquid holding portion 494L and a discharge flow path 80 are formed. In an illustrated example, the substrate holder 4400 includes a support member 4940. The support member 4940 is provided with the discharge port 90 on an inner lateral surface of the support member 4940 that constitutes a side wall of the liquid holding portion 494L. Since the discharge port 90 is formed inside the substrate holder 4400, contaminant contained in liquid L1 in the liquid holding portion 494L is discharged while a substrate Wf is attached, and adverse effect of the contaminant on a contact member 494-4 or the like can be suppressed. Further, by discharging the liquid L1 before removing the substrate Wf, risk of the liquid L1 dropping into the plating solution and diluting the plating solution can be reduced when removing the substrate Wf. The liquid L1 can be spouted and discharged, and hence more liquid L1 can be supplied to the liquid holding portion 494L since the supply is not limited by an amount of liquid L1 that can be held in the substrate holder 4400. The adverse effect of the contaminant on the contact member 494-4 or the like can be further suppressed.

The discharge flow path 80 extends through the inside of the substrate holder 4400 and communicates between the discharge port 90 and the outside of the substrate holder 4400. Thereby, the discharged liquid L1 can be appropriately adjusted not to drop into the plating solution and not to dilute the plating solution. The discharge of the liquid L1 from the discharge port 90 can be controlled with an unillustrated valve, pump, or the like provided in the discharge flow path 80. In the illustrated example, the discharge flow path 80 extends from the discharge port 90 through the inside of the support member 4940, a second upper member 496, a first upper member 493, and a rotary shaft 491 in this order, which is not limited thereto if the liquid L1 can be discharged from the inside of the substrate holder 4400. In the illustrated example, the liquid L1 discharged from the discharge flow path 80 to the outside of the substrate holder 4400 passes on the tray 406T and is subject to measurement of an electrical conductivity by the electrical conductivity meter 406. The plating module 4000 need not include the electrical conductivity meter.

Figure 31:
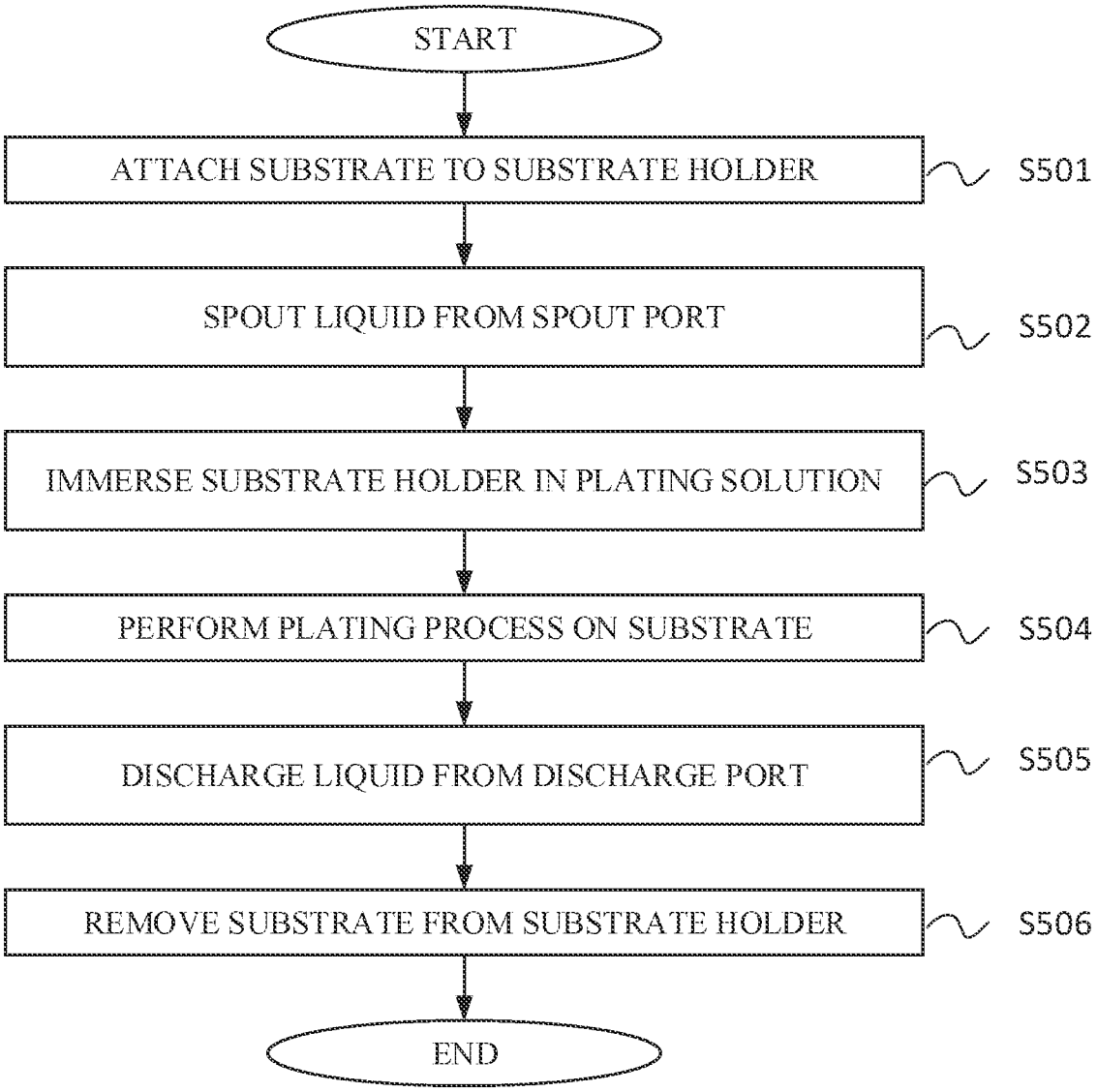
FIG. 31 is a flowchart illustrating a flow of a plating method of the second embodiment.

FIG. 31 is a flowchart illustrating a flow of an example of a plating method of the present embodiment. This plating method is performed by a control module 800. In step S501, the substrate Wf is attached to the substrate holder 4400. After step S501, step S502 is performed. In step S502, the liquid L1 is spouted from a spout port 60. The spouted liquid L1 is held in the liquid holding portion 494L. Here, the substrate holder 4400 may be rotated or tilted by a rotation mechanism 446 or a tilting mechanism 447 to move the liquid L1 to the liquid holding portion 494L or to distribute the liquid L1 more uniformly in the liquid holding portion 494L. After step S502, step S503 is performed.

In step S503, a first elevating/lowering mechanism 442 lowers the substrate holder 4400, to immerse the substrate holder 4400 in a plating solution. After step S503, step S504 is performed. In step S504, a plating process is performed on the substrate Wf. In steps S503 and S504, since the liquid L1 is held in the liquid holding portion 494L, a concentration of contaminant is reduced, and adverse effect of the contaminant on the contact member 494-4 or the like can be suppressed. After step S504, step S505 is performed.

In step S505, the liquid L1 is discharged from the discharge port 90. For example, while the liquid L1 is left to such an extent that the liquid coats a substrate contact 494-4*b* of the contact member 494-4, the liquid L1 can be discharged from the inside of the substrate holder 4400. All of the liquid L1 inside the substrate holder 4400 may be discharged. After step S505, step S506 is performed. In step S506, the substrate Wf is removed from the substrate holder 4400. An amount of liquid L1 inside the substrate holder 440 is reduced in step S505, and hence the liquid L1 can be inhibited from dropping into the plating solution and diluting the plating solution when the substrate Wf is removed. The removed substrate Wf is transferred to cleaning modules 500.

The following modifications are also within the scope of the present invention and can be combined with the above-described embodiment or other modifications. In the following modifications, parts exhibiting the same structure, function, and the like as in the above-described embodiment are denoted with the same reference numeral, and description thereof is not repeated as appropriate.

(Modification 2-1)

In the above-described embodiment, a spouting operation and a discharging operation may be performed while the substrate holder 4400 is immersed in the plating solution. Hereinafter, the operation of spouting the liquid L1 from the spout port 60 is called the spouting operation, and the operation of discharging the liquid L1 from the discharge port 90 is called the discharging operation.

Figure 32:
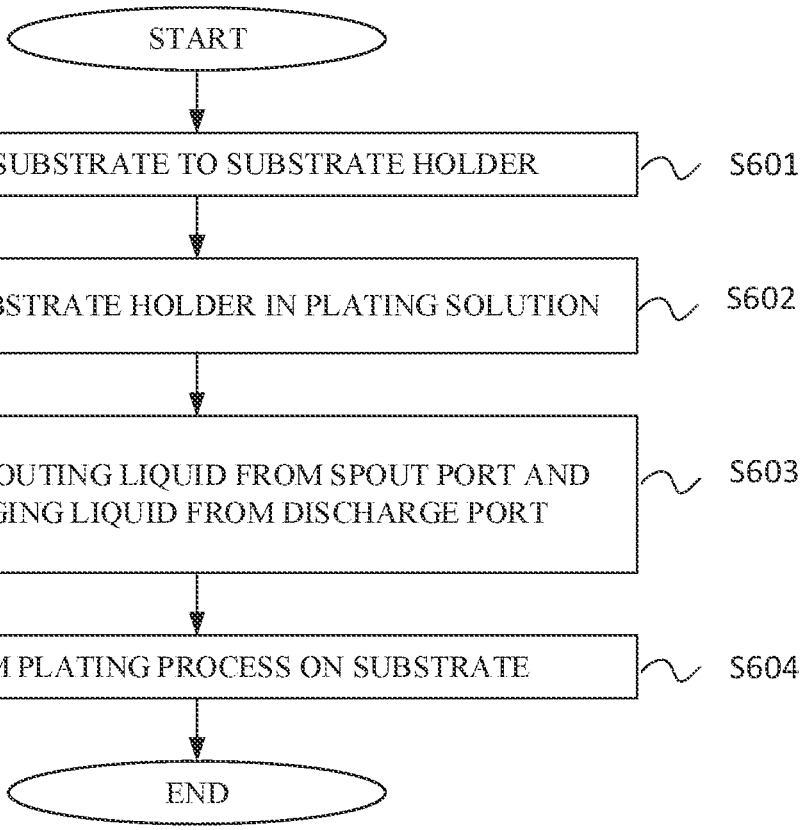
FIG. 32 is a flowchart illustrating a flow of a plating method of Modification 2-1.

FIG. 32 is a flowchart illustrating a flow of a plating method of this modification. This plating method is performed under control of the control module 800. In step S601, the substrate Wf is attached to the substrate holder 4400. After step S601, step S602 is performed. In step S602, the first elevating/lowering mechanism 442 lowers the substrate holder 4400, to immerse the substrate holder 4400 in the plating solution. After step S602, step S603 is performed.

In step S603, while the substrate holder 4400 is immersed in the plating solution, spouting the liquid L1 from the spout port 60 and discharging the liquid L1 from the discharge port 90 are performed. The spouting operation and the discharging operation may be performed once or more arbitrary times. If foreign matter adheres to or damages are caused on portions of a sealing member 494-2 and the substrate Wf that are in contact with each other, leakage might occur after sealing, and when the substrate holder 4400 is immersed in the plating solution, the plating solution or the like might intrude into the liquid holding portion 494L. In this modification, by performing the spouting operation and the discharging operation while the substrate holder 4400 is immersed in the plating solution, contaminant such as the plating solution that has intruded into the liquid holding portion after the immersion can be discharged, and adverse effect of the contaminant on the contact member 494-4 or the like can be reduced.

The control module 800 can stop the spouting operation and the discharging operation when the electrical conductivity of the discharged liquid L1 that is measured with the electrical conductivity meter 406 is equal to or less than a predetermined threshold. Thereby, the plating process can be performed more reliably in a state where the concentration of contaminant present in the liquid holding portion 494L is low, based on the electrical conductivity. After step S603, step S604 is performed. In step S604, the plating process is performed on the substrate Wf.

(Modification 2-2)

In the above-described embodiment, the spouting operation and the discharging operation may be performed while performing the plating process. Thereby, while the plating process is performed, the concentration of contaminant can be reduced more reliably, and the adverse effect of the contaminant on the contact member 494-4 or the like can be suppressed.

An amount of liquid L1 spouted to the inside of the substrate holder 4400 is called a spout amount, and an amount of liquid L1 discharged from the inside of the substrate holder 4400 is called a discharge amount. The control module 800 can control at least one of the spout amount and the discharge amount based on the electrical conductivity of the discharged liquid L1 that is measured with the electrical conductivity meter 406. For example, if a value of the measured electrical conductivity of the liquid L1 is higher than a predetermined threshold, both the spout amount and the discharge amount can be increased, whereas there are possibilities that the concentration of contaminant is high and that adverse effect of deposition or the like of metal components is caused. Alternatively, in this case, the spout amount alone may be increased to heighten a liquid level of the liquid holding portion 494L and to reduce the concentration of contaminant. It should be noted that the spout amount or discharge amount per unit time may be controlled as the spout amount or the discharge amount.

A mode of control of the spouting operation and discharging operation by the control module 800 is not particularly limited. The spouting operation and the discharging operation may be simultaneously performed in parallel or may be performed at different times.

The control module 800 may be configured to perform at least one of the spouting operation and the discharging operation intermittently. Thereby, while efficiently using the liquid L1, the adverse effect of the contaminant on the contact member 494-4 or the like can be reduced. The control module 800 may be configured to perform at least one of the spouting operation and the discharging operation at all times during the plating process. Thereby, during the plating process, the adverse effect of the contaminant on the plating process can be further reduced.

Figure 33:
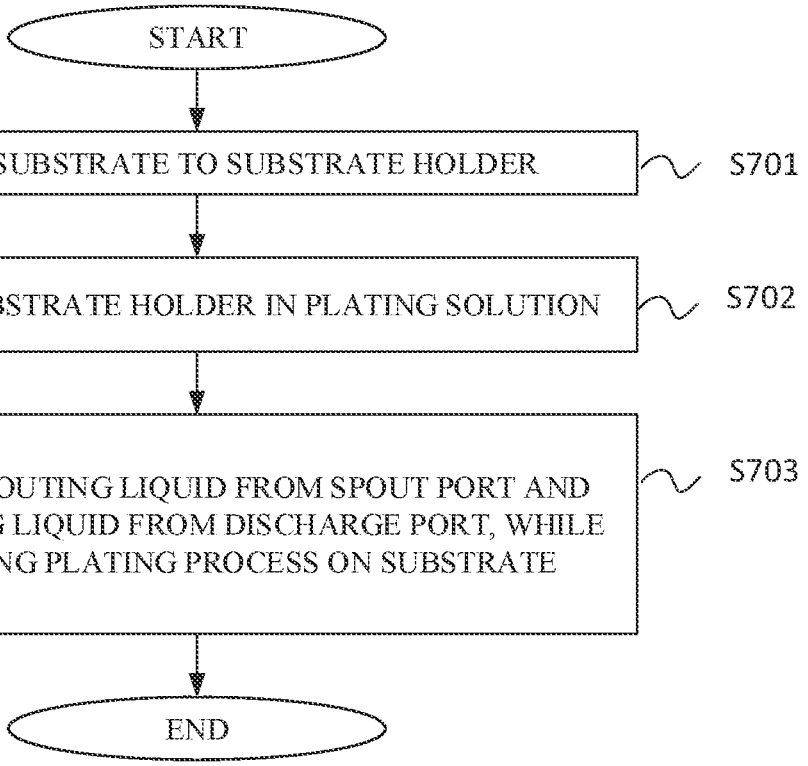
FIG. 33 is a flowchart illustrating a flow of a plating method of Modification 2-2.

FIG. 33 is a flowchart illustrating a flow of the plating method of this modification. This plating method is performed under control of the control module 800. Steps S701 and S702 are the same as steps S601 and S602 of the flowchart of FIG. 32 described above, and hence description thereof is not repeated. After step S702, step S703 is performed. In step S703, while performing a plating process on the substrate Wf, spouting the liquid L1 from the spout port 60 and discharging the liquid L1 from the discharge port 90 are performed. When the plating process ends, it is preferable that after the liquid L1 is discharged from the discharge port 90, the substrate Wf is removed from the substrate holder 4400.

(Modification 2-3)

In the above-described embodiment, when the substrate holder 4400 is immersed in the plating solution, a liquid level of the liquid L1 in the substrate holder 4400 may be lower than a liquid level of the plating solution in a plating tank 410.

Figure 34:
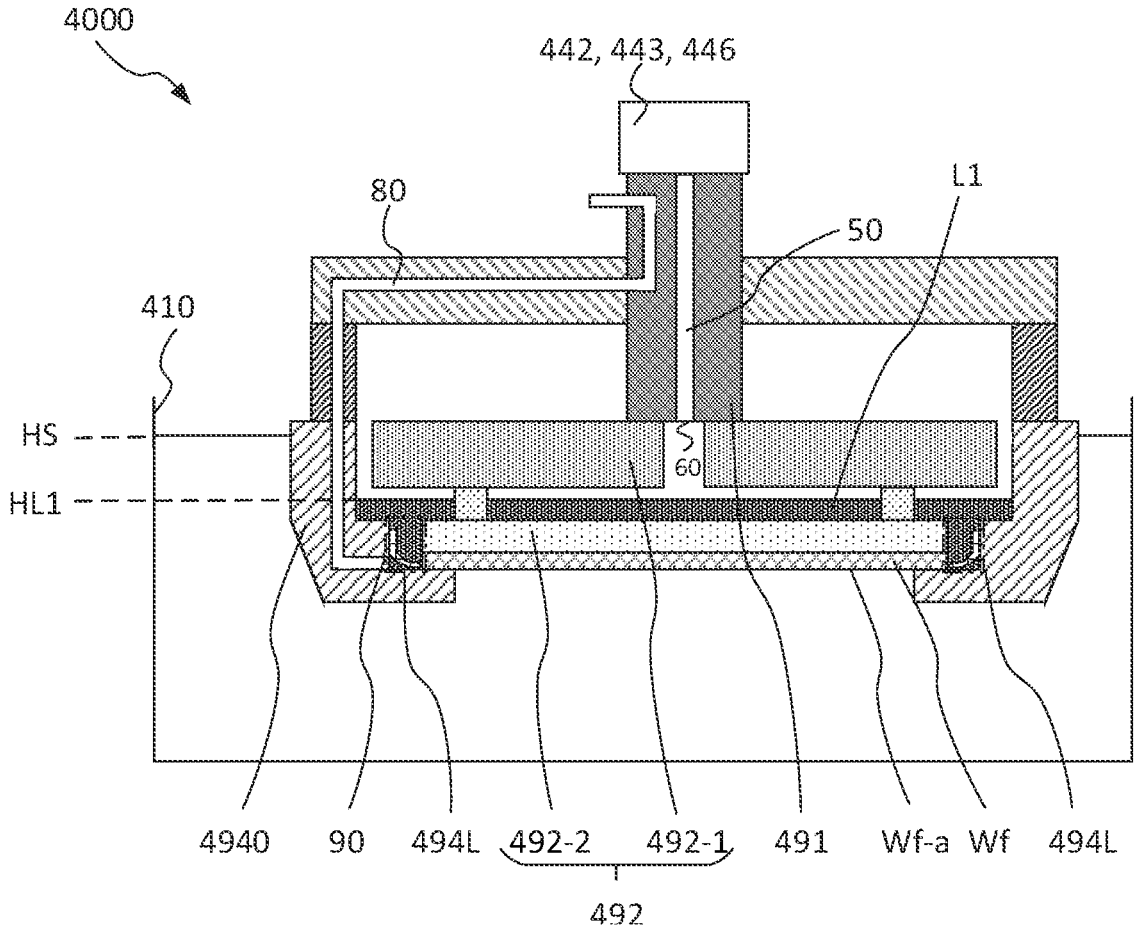
FIG. 34 is a longitudinal sectional view of a plating module for illustrating a plating method of Modification 2-3.

FIG. 34 is a longitudinal sectional view of the substrate holder 4400 schematically illustrating the plating method of this modification. The control module 800 controls the first elevating/lowering mechanism 442, or the spouting or discharging of the liquid L1 so that a height HL1 of the liquid level of the liquid L1 in the substrate holder 4400 is lower than a height HS of the liquid level of the plating solution. For example, it is assumed that the liquid level height HL1 of the liquid L1 is higher than the liquid level height HS of the plating solution. In this case, the first elevating/lowering mechanism 442 may lower the substrate holder 4400, or the liquid L1 may be spouted from the spout port 60 to raise the liquid level HL1 of the liquid L1.

The control module 800 of this modification is configured to immerse the substrate holder 4400 in the plating solution so that the liquid level HL1 of the liquid L1 in the substrate holder 4400 is lower than the liquid level HS of the plating solution. The inside of the plating tank 410 and the substrate holder 4400 is under atmospheric pressure, and hence this configuration makes a water pressure of the plating solution higher than a water pressure of the liquid L1, so that the liquid L1 can be inhibited from leaking to the plating solution and diluting the plating solution. Furthermore, by spouting and discharging the liquid L1 in the substrate holder 4400, a component such as the plating solution that intrudes into the substrate holder 4400 is also discharged. Thus, while reducing the concentration of contaminant in the vicinity of the contact member 494-4 and substrate Wf, dilution of the plating solution can also be suppressed. It should be noted that, when the discharge port 90 is formed in the substrate holder 4400, the liquid level of the liquid L1 may be higher than the back surface BS of the floating plate 492-2.

(Modification 2-4)

In the above-described embodiment, the discharge port of the liquid may be formed in the back plate assembly.

Figure 35:
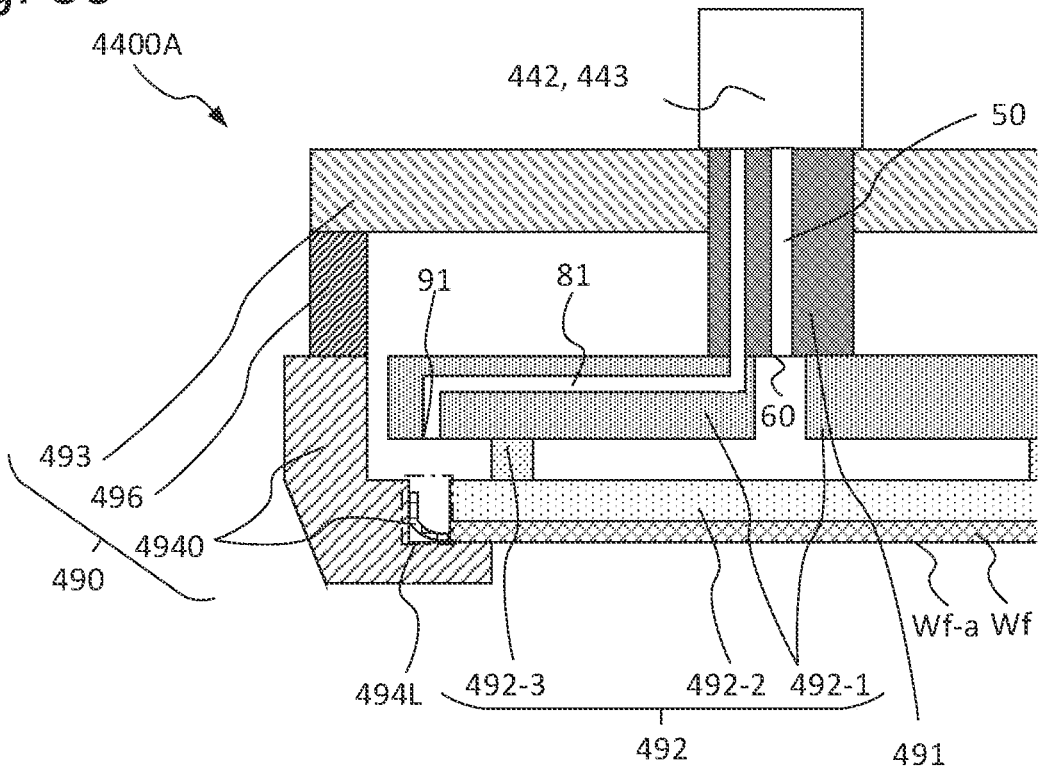
FIG. 35 is a longitudinal sectional view schematically illustrating a substrate holder of Modification 2-4.

FIG. 35 is a longitudinal sectional view schematically illustrating a substrate holder 4400A of this modification. The substrate holder 4400A includes substantially the same configuration as the substrate holder 4400 described above but is different from the substrate holder 4400 in that a discharge port 91 and a discharge flow path 81 are formed instead of the discharge port 90 and the discharge flow path 80. The discharge port 91 is formed on a surface of a back plate 492-1 on a substrate Wf side. The discharge flow path 81 is configured to discharge the liquid L1 from the discharge port 91 through the back plate 492-1 and the rotary shaft 491 to the outside of the substrate holder 4400A. Thus, since the discharge port 91 is formed on a member disposed on an upper side above the liquid holding portion 494L, the discharge flow path 91 can be shortened and the substrate holder 4400A including a simpler configuration can be achieved. Thus, from a viewpoint of enabling flexible design as required, the discharge port 91 may be provided on at least one of the rotary shaft 491, a back plate assembly 492, and a side wall constituting the liquid holding portion 494L.

(Modification 2-5)

In the above-described embodiment, the discharge port of the liquid may be formed at a position protruding in a space inside the substrate holder.

Figure 36:
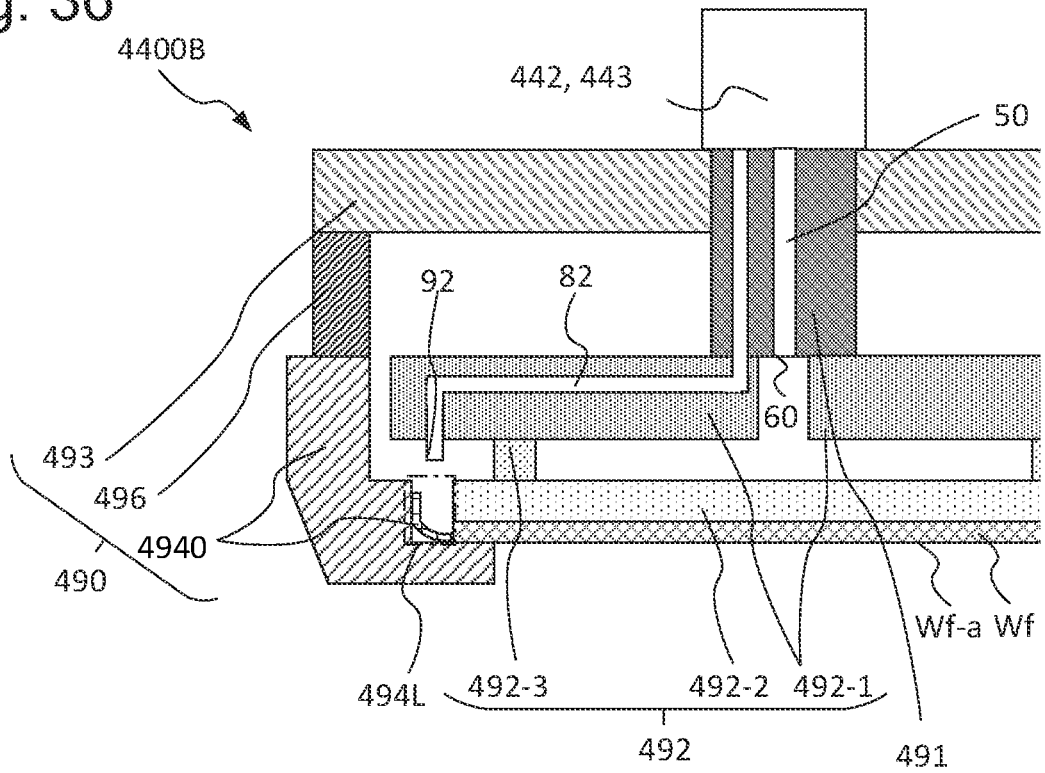
FIG. 36 is a longitudinal sectional view schematically illustrating the substrate holder of Modification 2-5.

FIG. 36 is a longitudinal sectional view schematically illustrating a substrate holder 4400B of this modification. The substrate holder 4400B includes substantially the same configuration as the substrate holder 4400 described above but is different from the substrate holder 4400 in that a discharge port 92 and a discharge flow path 82 are formed instead of the discharge port 90 and the discharge flow path 80. The discharge port 92 is formed at an end of a tubular member and is formed at a position protruding from the surface of the back plate 492-1 on the substrate Wf side. The discharge flow path 82 is configured to discharge the liquid L1 from the discharge port 92 through the back plate 492-1 and the rotary shaft 491 to the outside of the substrate holder 4400B. Thus, forming the discharge port 92 at a position protruding in a space inside the substrate holder 4400B can enable more flexible design of the substrate holder 4400B. Alternatively, the discharge port 92 may be formed at a position protruding from any portion of the substrate holder 4400B, other than the back plate 492-1.

(Modification 2-6)

In the above-described embodiment, the liquid discharged from the discharge port may be spouted from a spout port.

Figure 37:
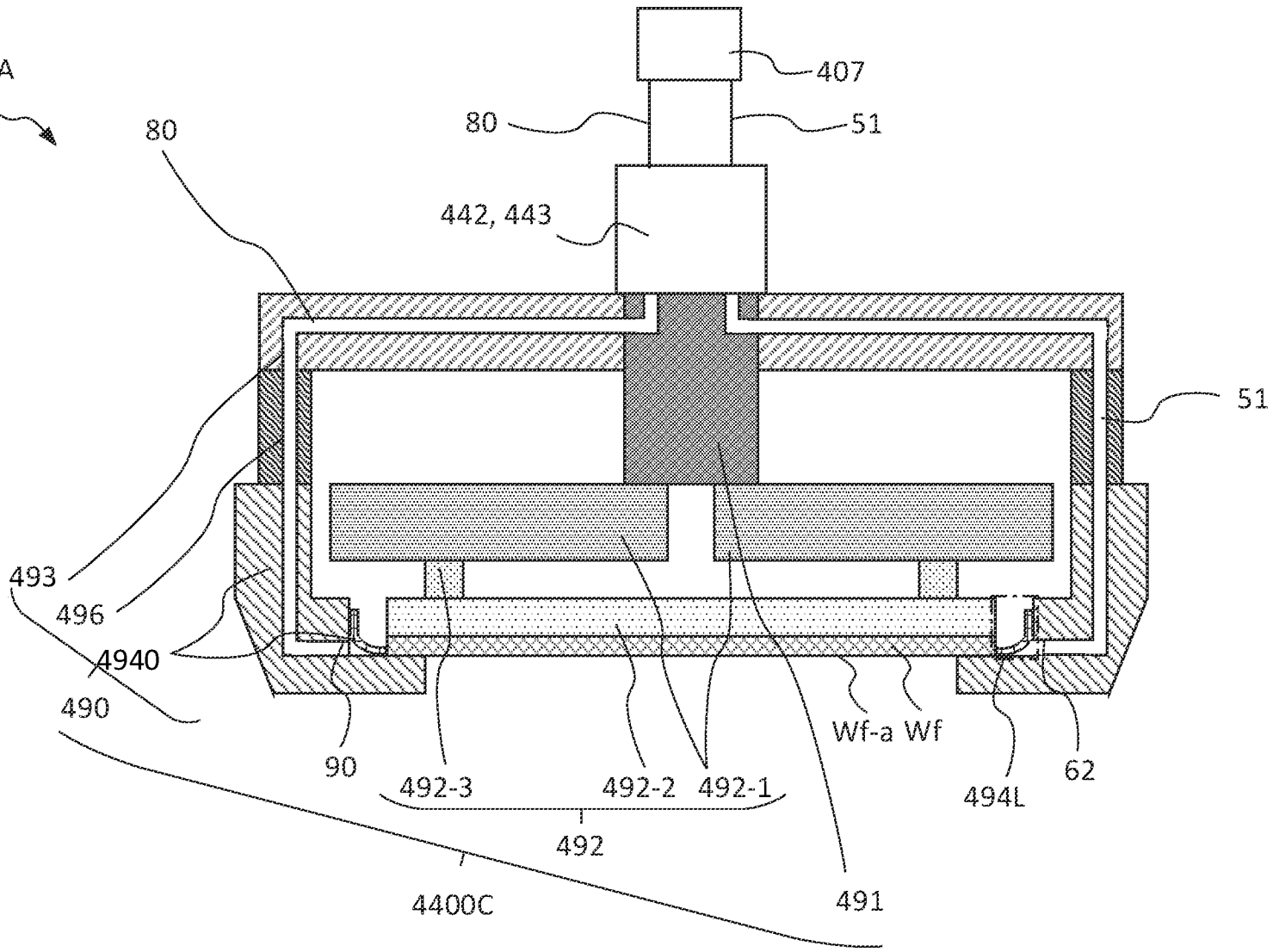
FIG. 37 is a longitudinal sectional view schematically illustrating a plating module of Modification 2-6.

FIG. 37 is a longitudinal sectional view schematically illustrating a plating module 4000A of this modification. The plating module 4000A includes substantially the same configuration as the plating module 4000 described above but is different from the plating module 4000 in including a substrate holder 4400C instead of the substrate holder 4400 and including an ion exchange column 407. The substrate holder 4400C includes substantially the same configuration as the substrate holder 4400 but is different from the substrate holder 4400 in including a spout port 62 and a supply flow path 51 instead of the spout port 60 and the supply flow path 50.

The spout port 62 is formed on an inner lateral surface of a support member 4940 constituting the liquid holding portion 494L. Therefore, in this modification, both the spout port 62 and the discharge port 90 are configured to open into the liquid holding portion 492L. The supply flow path 51 is connected such that the liquid L1 is movable from the ion exchange column 407 through the rotary shaft 491, the first upper member 493, the second upper member 496 and the support member 4940 to the spout port 62. The supply flow path 51 is connected such that the liquid L1 is also movable from an unillustrated liquid source.

Figure 38:
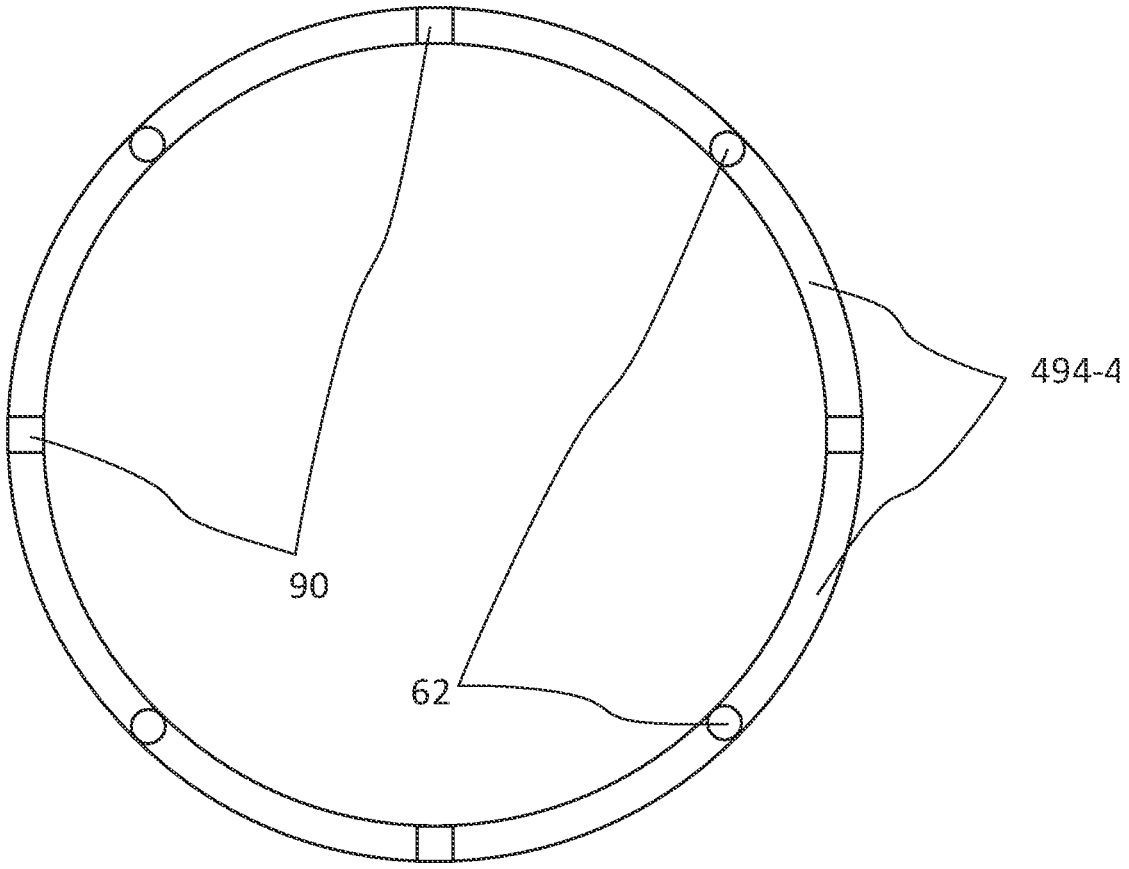
FIG. 38 is a conceptual diagram illustrating a contact member of Modification 2-6.

FIG. 38 is a conceptual diagram illustrating arrangement of spout ports 62 and discharge ports 90 in this modification. In this modification, the contact member 494-4 is arched, and in the liquid holding portion 494L, eight contact members 494-4 are annularly arranged. A spout port 62 or a discharge port 90 is disposed between two adjacent contact members 494-4. In an illustrated example, the spout port 62 and the discharge port 90 are arranged alternately along the circumferential direction, which is not particularly limited when spouting and discharging of the liquid L1 are possible. From the same viewpoint, the number of the spout ports 62 or the discharge ports 90 is not particularly limited if it is 1 or more. Each contact member 494-4 has a shape that is appropriately designed to easily supply power to the substrate Wf and that is not limited to the illustrated example.

Returning to FIG. 37, the liquid L1 discharged from the discharge port 90 is introduced through the discharge flow path 80 into the ion exchange column 407. The ion exchange column 407 includes an ion exchange resin capable of deionizing the liquid L1. In the ion exchange column 407, the liquid L1 is subjected to ion exchange and has an electrical conductivity reduced. The liquid L1 discharged from the ion exchange column 407 flows through the supply flow path 51 and is spouted from the spout port 62. The discharge flow path 80 and the supply flow path 51 constitute a flow path communicating between the discharge port 90 and the spout port 62 without extending through the liquid holding portion 494L and a space inside the substrate holder 4400C that communicates with the liquid holding portion 494L. Thus, the substrate holder 4000A includes a configuration where the liquid L1 circulates between the inside of the substrate holder 4400C and the outside thereof.

In the illustrated example, the ion exchange column 407 ensures that the electrical conductivity of the circulating liquid L1 is not high. However, the plating module 4000A may alternatively or additionally include the electrical conductivity meter 406 (FIG. 30) to the ion exchange column 407. In this case, when the electrical conductivity of the discharged liquid L1 that is measured with the electrical conductivity meter 406 is equal to or less than a predetermined threshold, new liquid L1 that has not been spouted into the substrate holder 4400C may be spouted from the spout port 62.

In the plating method of this modification, the substrate holder 4400C further includes a flow path that communicates between the discharge port 90 and the spout port 62 without extending through the liquid holding portion 494L and the space inside the substrate holder 4400C that communicates with the liquid holding portion 494L, and the control module 800 is configured to spout, from the spout port 62, the liquid L1 discharged from the discharge port 90. Thereby, while efficiently using the liquid L1, adverse effect of contaminant on the contact member 494-4 can be reduced. When circulating the liquid L1, the positions of the spout port 62 and the discharge port 90 are not particularly limited. The liquid L1 may be circulated via the spout port 60 of the above-described embodiment instead of the spout port 62. From a viewpoint of performing flexible design as required, such as shortening the supply flow path, the spout port 62 can be disposed on at least one of the rotary shaft 491, the back plate assembly 492, and the side wall constituting the liquid holding portion 494L.

(Modification 2-7)

In the above-described embodiment, the plating module 4000 need not include the rotation mechanism 446. The plating module 4000 may be configured as a dip type plating apparatus. In this case, as in PTL 3, the substrate Wf, the resistor 450, and the anode 430 can be each disposed along the vertical direction. Even if the substrate holder 4400 is not rotated, the contact member 494-4 and the like can be cleaned by performing the spouting operation and discharging operation at a time of at least one of times before immersing of the substrate holder 4400, during the immersing, during the plating process and after end of the immersing.

The present invention can be described in the following aspects.

[Aspect 1] According to Aspect 1, a plating apparatus is provided, and the plating apparatus includes a plating tank configured to store a plating solution, a substrate holder configured to hold a substrate as a target on which a plating process is performed, a rotation mechanism that rotates the substrate holder, an elevating/lowering mechanism that elevates and lowers the substrate holder, and a control device, and the substrate holder includes a contact member configured to contact the substrate to be able to supply power to the substrate, a sealing member configured to seal a gap between the substrate holder and the substrate, a pressing member disposed opposing the sealing member, and configured to press the substrate against the sealing member, a liquid holding portion including the contact member inside, and being configured to be able to hold liquid when the substrate is sealed with the sealing member, and a spout port that is configured to open into the liquid holding portion or a space communicating with the liquid holding portion inside the substrate holder, or that can be disposed on a side of the substrate holder, to spout the liquid. According to Aspect 1, the plating apparatus capable of suppressing adverse effect of contaminant inside the substrate holder on the contact member or the like can be provided.

[Aspect 2] According to Aspect 2, in Aspect 1, the spout port is formed on at least one of a side wall constituting the liquid holding portion, and a rotary shaft and a back plate assembly of the substrate holder. According to Aspect 2, flexible design can be performed as required, such as shortening a supply flow path of liquid.

[Aspect 3] According to Aspect 3, in Aspect 1 or 2, the liquid holding portion includes an outer lateral surface of the pressing member, and an inner lateral surface and a bottom surface of a support member supporting the contact member. According to Aspect 3, the contact member can be efficiently coated with a small amount of liquid, when the substrate is sealed with the sealing member.

[Aspect 4] According to Aspect 4, in any of Aspects 1 to 3, the control device is configured to spout the liquid through the spout port to the liquid holding portion or the space communicating with the liquid holding portion, when the substrate is sealed with the sealing member. According to Aspect 4, the liquid can be stored in the liquid holding portion in a state of being able to hold the liquid, and adverse effect of contaminant on the contact member or the like can be suppressed.

[Aspect 5] According to Aspect 5, in any of Aspects 1 to 4, the substrate holder is configured to hold the substrate with a surface to be plated being oriented downward, and the rotation mechanism rotates the substrate holder about an axis intersecting the surface to be plated, as a rotation axis, when the substrate is disposed in the substrate holder. According to Aspect 5, by use of the rotation mechanism, the liquid spouted into the substrate holder can be moved to the liquid holding portion and distributed more uniformly in the liquid holding portion. Further, the plating process is performed while rotating the substrate holder, so that a thickness of formed plating can be made uniform.

[Aspect 6] According to Aspect 6, in Aspect 5, the spout port is formed above the pressing member, and configured to spout the liquid to a back surface opposite to a surface on which the substrate is disposed in the pressing member. According to Aspect 6, since the spout port is formed above the pressing member, the supply flow path to the spout port can be shortened and simplified. Further, in the configuration where the liquid is spouted to the back surface of the pressing member, the liquid can be supplied to the contact member efficiently by use of the rotation mechanism.

[Aspect 7] According to Aspect 7, in Aspect 6, on the back surface of the pressing member, a recess through which the liquid flows or that holds the liquid is formed. According to Aspect 7, the liquid can be efficiently moved to the liquid holding portion, or the liquid can be distributed more uniformly to the liquid holding portion.

[Aspect 8] According to Aspect 8, in Aspect 7, the recess is radially formed, formed to surround a central axis of the pressing member, or formed on an outer peripheral portion of the pressing member. According to Aspect 8, more reliably, the liquid can be efficiently moved to the liquid holding portion, or the liquid can be distributed more uniformly to the liquid holding portion.

[Aspect 9] According to Aspect 9, in any one of Aspects 6 to 8, the control device is configured to spout the liquid from the spout port, and clean at least one of the back surface, the contact member, the liquid holding portion and the sealing member, when the substrate is not attached to the substrate holder. According to Aspect 9, the contact member and the like can be inhibited from being damaged by the contaminant, after the substrate is removed.

[Aspect 10] According to Aspect 10, in Aspect 9, the liquid holding portion includes an inclined surface that increases in height outward in a radial direction, and the control device is configured to control the rotation mechanism to rotate the substrate holder in a state where the pressing member is in contact with the sealing member when the substrate is not attached to the substrate holder, and thereby discharge the liquid from the liquid holding portion beyond the inclined surface to the outside of the inclined surface. According to Aspect 10, the liquid flows smoothly outward in the radial direction, and hence the contact member can be efficiently cleaned.

[Aspect 11] According to Aspect 11, in any of Aspects 5 to 10, the control device is configured to spout the liquid to the space through the spout port, then control the rotation mechanism to rotate the substrate holder, and thereby move the liquid to the liquid holding portion or distribute the liquid more uniformly in the liquid holding portion. According to Aspect 11, during the plating process, the liquid can be supplied to the contact member by appropriately using the rotation mechanism for making a thickness of formed plating more uniform.

[Aspect 12] According to Aspect 12, in any of Aspects 1 to 11, the plating apparatus further includes a tilting mechanism that tilts the substrate holder, and the control device is configured to spout the liquid to the space through the spout port, then control the tilting mechanism to tilt the substrate holder, and thereby move the liquid to the liquid holding portion or distribute the liquid more uniformly in the liquid holding portion. According to Aspect 12, gravity can be used to more reliably supply liquid to the contact member.

[Aspect 13] According to Aspect 13, in Aspect 12, when the elevating/lowering mechanism is controlled to immerse the substrate holder to which the substrate is attached into the plating tank, the control device is configured to control the tilting mechanism to tilt the substrate holder, and thereby move the liquid to the liquid holding portion. According to Aspect 13, the liquid can be moved to the liquid holding portion while immersing the substrate holder so that foam does not enter the surface to be plated.

[Aspect 14] According to Aspect 14, in any of Aspects 1 to 13, the control device is configured to spout a preset amount of the liquid to a liquid level of the liquid that is at a height between a lower surface of the substrate and an upper surface of the pressing member in the liquid holding portion. According to Aspect 14, while sufficiently coating the contact member with liquid, adverse effect of dissolved oxygen on a seed layer can be reduced. In addition, the substrate can be efficiently rotated, and risk of liquid dropping into the plating solution and diluting the plating solution can be reduced.

[Aspect 15] According to Aspect 15, any one of Aspects 1 to 14 further includes a discharge port that opens into the liquid holding portion or the space communicating with the liquid holding portion, to discharge the liquid present in the liquid holding portion or the space. According to Aspect 15, while the substrate is attached to the substrate holder, the contaminant contained in the liquid can be discharged, and the adverse effect of the contaminant on the contact member or the like can be suppressed.

[Aspect 16] According to Aspect 16, in Aspect 15, the discharge port is formed on at least one of a side wall constituting the liquid holding portion, and a rotary shaft and a back plate assembly of the substrate holder. According to Aspect 16, flexible design can be performed as required, such as shortening a discharge flow path.

[Aspect 17] According to Aspect 17, in Aspect 15 or 16, the substrate holder further includes a flow path communicating between the discharge port and the outside of the substrate holder. According to Aspect 17, the discharged liquid can be appropriately adjusted not to drop into the plating solution and not to dilute the plating solution.

[Aspect 18] According to Aspect 18, in Aspect 15 or 16, the substrate holder further includes a flow path that communicates between the discharge port and the spout port without extending through the liquid holding portion and the space, and the control device is configured to spout, from the spout port, the liquid discharged from the discharge port. According to Aspect 18, while efficiently using the liquid, the adverse effect of the contaminant on the contact member or the like can be reduced.

[Aspect 19] According to Aspect 19, Aspect 18 further includes at least one of an ion exchange resin and an electrical conductivity meter that are arranged in the flow path. According to Aspect 19, the discharged liquid can be spouted from the spout port with a low electrical conductivity.

[Aspect 20] According to Aspect 20, in any of Aspects 15 to 19, the control device is configured to perform a spouting operation of spouting the liquid from the spout port, and a discharging operation of discharging, from the discharge port, at least part of the liquid held in the liquid holding portion, simultaneously in parallel or at different times, in a state where the substrate is attached to the substrate holder. According to Aspect 20, without being limited to an amount of liquid that can be held in the substrate holder, more liquid can be supplied to the liquid holding portion, and the adverse effect of the contaminant on the contact member or the like can be further suppressed.

[Aspect 21] According to Aspect 21, in Aspect 20, the control device is configured to perform the spouting operation and the discharging operation in a state where the substrate holder to which the substrate is attached is immersed in the plating solution. According to Aspect 21, it is possible to discharge contaminant such as the plating solution that intrudes by immersion, and to reduce the adverse effect of the contaminant on the contact member or the like.

[Aspect 22] According to Aspect 22, in Aspect 21, the control device is configured to immerse the substrate holder in the plating solution so that a liquid level of the liquid in the substrate holder is lower than a liquid level of the plating solution. According to Aspect 22, a water pressure of the plating solution is higher than a water pressure of the liquid inside the substrate holder, and hence the liquid can be inhibited from leaking and diluting the plating solution.

[Aspect 23] According to Aspect 23, in Aspect 21 or 22, the control device is configured to perform the spouting operation and the discharging operation in a state where the plating process is performed. According to Aspect 23, it is possible to more reliably suppress adverse effect of contaminant on the contact member or the like while performing the plating process.

[Aspect 24] According to Aspect 24, in any of Aspects 20 to 23, the control device is configured to perform the discharging operation after the plating process is performed and before the substrate is removed. According to Aspect 24, the liquid can be inhibited from dropping into the plating solution and diluting the plating solution when removing the substrate.

[Aspect 25] According to Aspect 25, in any of Aspects 20 to 24, the control device is configured to perform at least one of the spouting operation and the discharging operation intermittently. According to Aspect 25, while efficiently using the liquid, the adverse effect of the contaminant on the contact member or the like can be reduced.

[Aspect 26] According to Aspect 26, in any of Aspects 20 to 24, the control device is configured to perform at least one of the spouting operation and the discharging operation at all times during the plating process. According to Aspect 26, it is possible to further reliably reduce the adverse effect of the contaminant on the contact member or the like.

[Aspect 27] According to Aspect 27, in any of Aspects 1 to 26, the liquid has a low electrical conductivity based on a predetermined threshold or is deaerated. According to Aspect 27, it is possible to suppress adverse effect on the contact member or the like due to ions, dissolved oxygen or the like contained in the liquid.

[Aspect 28] According to Aspect 28, a plating method is provided, and the plating method is a plating method for performing a plating process with a plating apparatus including a plating tank configured to store a plating solution, a substrate holder configured to hold a substrate as a target on which the plating process is performed, a rotation mechanism that rotates the substrate holder, and an elevating/lowering mechanism that elevates and lowers the substrate holder, the substrate holder comprising a contact member configured to contact the substrate to be able to supply power to the substrate, a sealing member configured to seal a gap between the substrate holder and the substrate, a liquid holding portion including the contact member inside and being configured to be able to hold liquid when the gap between the substrate holder and the substrate is sealed with the sealing member, and a spout port that opens into the liquid holding portion or a space communicating with the liquid holding portion in the substrate holder, or that can be disposed on a side of the substrate holder, the plating method including attaching the substrate to the substrate holder, spouting the liquid from the spout port, rotating the substrate holder to move the spouted liquid to the liquid holding portion or to distribute the liquid more uniformly in the liquid holding portion, and performing the plating process on the attached substrate. According to Aspect 28, it is possible to suppress adverse effect of contaminant inside the substrate holder on the contact member or the like.

Although the embodiments of the present invention have been described above, the described embodiments are for the purpose of facilitating the understanding of the present invention and are not intended to limit the present invention. The present invention may be modified and improved without departing from the spirit thereof, and the invention includes equivalents thereof. In addition, the embodiments and modifications can be arbitrarily combined, and the elements described in the claims and the specification can be arbitrarily combined or omitted within a range in which the above-mentioned problems are at least partially solved, or within a range in which at least a part of the advantages is achieved.

REFERENCE SIGNS LIST

40A, 40B, 40C recess
50, 51 supply flow path
60, 61, 62 spout port
80, 81, 82 discharge flow path
90, 91, 92 discharge port
400, 400A, 400B, 400C, 4000, 4000A plating module
406 electrical conductivity meter
407 ion exchange column
410 plating tank
440, 440A, 440B, 4400, 4400A, 4400B, 4400C substrate holder
442 first elevating/lowering mechanism
443 second elevating/lowering mechanism
446 rotation mechanism
447 tilting mechanism
470 cleaning device
482 cleaning nozzle
490 supporter
491 rotary shaft
492 back plate assembly
492-1 back plate
492-2, 492-2A, 492-2B, 492-2C floating plate
494, 494A, 4940 support mechanism
494L liquid holding portion
494S inclined surface
494-1 support member
494-2 sealing member
494-4 contact member
494-4*a* substrate contact
494-4*b* main body portion
600 liquid supply device
800 control module
1000 plating apparatus
Ax1 central axis of floating plate
BS back surface of floating plate
H1 height of surface to be plated
H2 height of back surface of floating plate
HL1 height of liquid level of spouted liquid
HS height of liquid level of plating solution
L1, L2 liquid
SI inner space
Wf substrate
Wf-a surface to be plated

What is claimed is:

1. A plating apparatus comprising:
a plating tank configured to store a plating solution,
a substrate holder configured to hold a substrate as a target on which a plating process is performed,
a motor that rotates the substrate holder,
and
a control device,
the substrate holder including:
a contact member configured to contact the substrate to be able to supply power to the substrate,
a sealing member configured to seal a gap between the substrate holder and the substrate,
a pressing member disposed opposing the sealing member and configured to press the substrate against the sealing member,
a liquid holding portion including the contact member inside and being configured to be able to hold liquid when the gap between the substrate holder and the substrate is sealed with the sealing member, and
a spout port that is configured to open into the liquid holding portion or a space communicating with the liquid holding portion inside the substrate holder, or that can be disposed on a side of the substrate holder, to spout the liquid,
wherein the liquid holding portion includes an outer lateral surface of the pressing member, and an inner lateral surface and a bottom surface of a support member supporting the contact member.

2. The plating apparatus according to claim 1, wherein the spout port is formed on at least one of a side wall constituting the liquid holding portion, a rotary shaft of the substrate holder, and a back plate assembly of the substrate holder.

3. The plating apparatus according to claim 1, wherein the control device is configured to spout the liquid through the spout port to the liquid holding portion or the space communicating with the liquid holding portion, when the substrate is sealed with the sealing member.

4. The plating apparatus according to claim 1, wherein the substrate holder is configured to hold the substrate with a surface to be plated being oriented downward, and the motor rotates the substrate holder about an axis intersecting the surface to be plated, as a rotation axis, when the substrate is disposed in the substrate holder.

5. The plating apparatus according to claim 4, wherein the spout port is formed above the pressing member, and configured to spout the liquid to a back surface opposite to a surface on which the substrate is disposed in the pressing member.

6. The plating apparatus according to claim 5, wherein on the back surface of the pressing member, a recess through which the liquid flows or that holds the liquid is formed.

7. The plating apparatus according to claim 6, wherein the recess is radially formed, formed to surround a central axis of the pressing member, or formed on an outer peripheral portion of the pressing member.

8. The plating apparatus according to claim 5, wherein the control device is configured to spout the liquid from the spout port, and clean at least one of the back surface, the contact member, the liquid holding portion and the sealing member, when the substrate is not attached to the substrate holder.

9. The plating apparatus according to claim 8, wherein the liquid holding portion includes an inclined surface that increases in height outward in a radial direction, and the control device is configured to control the motor to rotate the substrate holder in a state where the pressing member is in contact with the sealing member when the substrate is not attached to the substrate holder, and thereby discharge the liquid from the liquid holding portion beyond the inclined surface to the outside of the inclined surface.

10. The plating apparatus according to claim 4, wherein the control device is configured to spout the liquid to the space through the spout port, then control the motor to rotate the substrate holder, and thereby move the liquid to the liquid holding portion or distribute the liquid more uniformly in the liquid holding portion.

11. The plating apparatus according to claim 1, further comprising:

a tilting mechanism that tilts the substrate holder, wherein the control device is configured to spout the liquid to the space through the spout port, then control the tilting mechanism to tilt the substrate holder, and thereby move the liquid to the liquid holding portion or distribute the liquid more uniformly in the liquid holding portion.

12. The plating apparatus according to claim 11, further comprising an elevating/lowering mechanism that elevates and lowers the substrate holder, wherein when the elevating/lowering mechanism is controlled to immerse the substrate holder to which the substrate is attached into the plating tank, the control device is configured to control the tilting mechanism to tilt the substrate holder, and thereby move the liquid to the liquid holding portion.

13. The plating apparatus according to claim 1, wherein the control device is configured to spout a preset amount of the liquid to a liquid level of the liquid that is at a height between a lower surface of the substrate and an upper surface of the pressing member in the liquid holding portion.

14. The plating apparatus according to claim 1, further comprising:

a discharge port that opens into the liquid holding portion or the space communicating with the liquid holding portion, to discharge the liquid present in the liquid holding portion or the space.

15. The plating apparatus according to claim 14, wherein the discharge port is formed on at least one of a side wall constituting the liquid holding portion, a rotary shaft of the substrate holder, and a back plate assembly of the substrate holder.

16. The plating apparatus according to claim 14, wherein the substrate holder further includes a flow path communicating between the discharge port and the outside of the substrate holder.

17. The plating apparatus according to claim 14, wherein the substrate holder further includes a flow path that communicates between the discharge port and the spout port without extending through the liquid holding portion and the space, wherein the control device is configured to spout, from the spout port, the liquid discharged from the discharge port.

18. The plating apparatus according to claim 17, wherein the substrate holder further includes at least one of an ion exchange resin and an electrical conductivity meter that are arranged in the flow path.

19. The plating apparatus according to claim 14, wherein the control device is configured to perform a spouting operation of spouting the liquid from the spout port, and a discharging operation of discharging, from the discharge port, at least part of the liquid held in the liquid holding portion, simultaneously in parallel or at different times, in a state where the substrate is attached to the substrate holder.

20. The plating apparatus according to claim 19, wherein the control device is configured to perform the spouting operation and the discharging operation in a state where the substrate holder to which the substrate is attached is immersed in the plating solution.

21. The plating apparatus according to claim 20, wherein the control device is configured to immerse the substrate holder in the plating solution so that a liquid level of the liquid in the substrate holder is lower than a liquid level of the plating solution.

22. The plating apparatus according to claim 20, wherein the control device is configured to perform the spouting operation and the discharging operation in a state where the plating process is performed.

23. The plating apparatus according to claim 19, wherein the control device is configured to perform the discharging operation after the plating process is performed and before the substrate is removed.

24. The plating apparatus according to claim 19, wherein the control device is configured to perform at least one of the spouting operation and the discharging operation intermittently.

25. The plating apparatus according to claim 19, wherein the control device is configured to perform at least one of the spouting operation and the discharging operation at all times during the plating process.

26. The plating apparatus according to claim 1, wherein the liquid has a low electrical conductivity based on a predetermined threshold or is deaerated.

27. A plating method for performing a plating process with a plating apparatus comprising:

a plating tank configured to store a plating solution, a substrate holder configured to hold a substrate as a target on which the plating process is performed, and a rotation mechanism that rotates the substrate holder, the substrate holder comprising:

a contact member configured to contact the substrate to be able to supply power to the substrate, a sealing member configured to seal a gap between the substrate holder and the substrate, a liquid holding portion including the contact member inside and being configured to be able to hold liquid when the gap between the substrate holder and the substrate is sealed with the sealing member, and a spout port that opens into the liquid holding portion or a space communicating with the liquid holding portion in the substrate holder, or that can be disposed on a side of the substrate holder, to spout the liquid, wherein the liquid holding portion includes an outer lateral surface of the pressing member, and an inner lateral surface and a bottom surface of a support member supporting the contact member, the plating method comprising:

attaching the substrate to the substrate holder, spouting the liquid from the spout port, rotating the substrate holder to move the spouted liquid to the liquid holding portion or to distribute the liquid more uniformly in the liquid holding portion, and performing the plating process on the attached substrate.

28. A plating apparatus comprising:

a plating tank configured to store a plating solution, a substrate holder configured to hold a substrate as a target on which a plating process is performed, a motor that rotates the substrate holder, and a control device, the substrate holder including:

a contact member configured to contact the substrate to be able to supply power to the substrate, a sealing member configured to seal a gap between the substrate holder and the substrate, a pressing member disposed opposing the sealing member and configured to press the substrate against the sealing member, a liquid holding portion including the contact member inside and being configured to be able to hold liquid when the gap between the substrate holder and the substrate is sealed with the sealing member, and a spout port that is configured to open into the liquid holding portion or a space communicating with the liquid holding portion inside the substrate holder, or that can be disposed on a side of the substrate holder, to spout the liquid, wherein the substrate holder is configured to hold the substrate with a surface to be plated being oriented downward, and the motor rotates the substrate holder about an axis intersecting the surface to be plated, as a rotation axis, when the substrate is disposed in the substrate holder, and wherein the spout port is formed above the pressing member, and configured to spout the liquid to a back surface opposite to a surface on which the substrate is disposed in the pressing member.

* * * * *